US008191611B2

(12) United States Patent
Okada et al.

(10) Patent No.: US 8,191,611 B2
(45) Date of Patent: Jun. 5, 2012

(54) METHOD FOR CONTINUOUS CASTING OF STEEL AND ELECTROMAGNETIC STIRRER TO BE USED THEREFOR

(75) Inventors: Nobuhiro Okada, Amagasaki (JP); Sei Hiraki, Kashima (JP); Kouji Takatani, Kamisu (JP); Akihiro Yamanaka, Kashima (JP); Hidetoshi Suwa, Itako (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 13/227,737

(22) Filed: Sep. 8, 2011

(65) Prior Publication Data

US 2012/0012274 A1 Jan. 19, 2012

Related U.S. Application Data

(60) Division of application No. 12/913,290, filed on Oct. 27, 2010, now Pat. No. 8,033,319, which is a continuation of application No. PCT/JP2009/055925, filed on Mar. 25, 2009.

(30) Foreign Application Priority Data

Apr. 28, 2008 (JP) ..... 2008-116548
Apr. 28, 2008 (JP) ..... 2008-116646

(51) Int. Cl.
*B22D 11/115* (2006.01)

(52) U.S. Cl. ..... 164/504; 164/468

(58) Field of Classification Search ..... 164/468, 164/504

See application file for complete search history.

(56) References Cited

U.S. PATENT DOCUMENTS

2006/0137776 A1 6/2006 Yamasaki et al.

FOREIGN PATENT DOCUMENTS

| | | |
|---|---|---|
| JP | 5234007 | 9/1993 |
| JP | 07-246445 | 9/1995 |
| JP | 3119203 | 10/2000 |
| JP | 3237177 | 10/2001 |
| JP | 3275835 | 2/2002 |
| JP | 2004-074233 | 3/2004 |
| JP | 2005-103604 | 4/2005 |
| JP | 2005-305517 | 11/2005 |
| JP | 4218383 | 11/2008 |

*Primary Examiner* — Kuang Lin
(74) *Attorney, Agent, or Firm* — Clark & Brody

(57) ABSTRACT

An electromagnetic stirrer for stirring molten steel of the liquid core in a width-wise direction of the slab includes an iron core disposed with its length-wise axis along a width-wise direction of slab, and a plurality of exciting coils wound around the outer circumference of and about a length-wise axis of the iron core, wherein two-phase or three-phase alternating current is passed through the coils. The phases of the current in the exciting coils are distributed to impart a stirring flow to the molten that includes flow from the minor sides to the center of the slab or from one minor side to the other minor side with a reversing flow at predetermined time intervals.

1 Claim, 11 Drawing Sheets

(a)

(b)

METHOD FOR CONTINUOUS CASTING OF STEEL AND ELECTROMAGNETIC STIRRER TO BE USED THEREFOR

FIELD OF THE INVENTION

The present invention relates to a continuous casting method in which, in order to decrease center segregation, one of stirring flow patterns is selected to electromagnetically stir molten steel of an unsolidified, liquid core, and a slab with a liquid core is reduced in thickness by means of reduction rolls, desirably while adjusting the amount of thickness reduction according to the amount of superheat of molten steel. The present invention further relates to an electromagnetic stirrer which can effectively stir, in execution of this continuous casting method, concentrated molten steel which is discharged upstream in the casting direction when reducing the liquid core in thickness.

BACKGROUND ART

Conventionally, with the aim of improving the internal quality of continuously-cast slabs, a number of techniques for reducing a slab with a liquid core using reduction rolls installed within a curved type or vertical bending type continuous casting machine (hereinafter referred also to as "liquid core reduction rolling technique") are proposed. The present inventors also proposed, in Japanese Patent No. 4218383 (hereinafter referred to as "Patent Literature 1"), a continuous casting method of steel, including: reducing a slab with a liquid core in thickness after bulging it, while projecting a lower roll of a pair of reduction rolls above a lower pass line of the slab in a continuous casting machine.

In the liquid core reduction rolling for a slab, molten steel in which elements likely to segregate such as C, Mn, P and S are concentrated (hereinafter referred also to as "segregation-elements-concentrated molten steel") is discharged to the liquid phase territory by the reduction rolling, whereby compositional segregation in the thickness-wise central part of the slab is improved.

In such a liquid core reduction rolling technique for slabs, if a solidified shell is formed non-uniformly in a width-wise direction of slab, the slab cannot be reduced uniformly in thickness along a width-wise direction. Therefore, the present applicant proposed a method for performing a flow control of molten steel for uniformity of a solidified shell. Concretely, in order to control the geometry along a width-wise direction of slab at a crater end, the present inventors proposed, in Japanese Patent No. 3275835 (hereinafter referred to as "Patent Literature 2") and Japanese Patent No. 3237177 (hereinafter referred to as "Patent Literature 3"), methods for electromagnetically control flow of molten metal within a mold where the formation of a solidified shell is started.

The method proposed in Patent Literature 2 is a continuous casting method, including: applying a static magnetic field to the cavity of a continuous casting mold in order to obtain an uniform thickness distribution, in a width-wise direction of slab, of a liquid core of a continuously-cast slab at a reduction rolling position, or in order to make thicknesses of width-wise end portions, of the slab to be smaller than that in the width-wise central part of the slab.

The method proposed in Patent Literature 3 is a continuous casting method in which, in order to prevent center segregation, a slab with a liquid core is continuously reduced in thickness while the shape of a solidification line within the slab is controlled so as to decrease the thickness of shell at the central part of the slab by controlling the flow of molten metal continuously supplied into a mold through electromagnetic force of an electromagnetic stirrer located at a distance of 3 to 7 m upstream of a pair of reduction rolls.

The present inventors further proposed, with the aim of controlling the equiaxed structure, continuous casting methods, including: electromagnetically stirring unsolidified molten steel at the upstream site, in the casting direction, relative to a reduction rolling position in Japanese Patent No. 3119203 (hereinafter referred to as "Patent Literature 4"), Japanese Patent Application Publication No. 2005-103604 (hereinafter referred to as "Patent Literature 5") and Japanese Patent Application Publication No. 2005-305517 (hereinafter referred to as "Patent Literature 6").

The method proposed in Patent Literature 4 is a method for a liquid core reduction rolling of a slab, including: performing electromagnetic stirring within a mold, further performing electromagnetic stirring of unsolidified molten steel in an unsolidified region of slab with a center solid fraction of 0 to 0.1, and successively imparting an amount of thickness reduction corresponding to 50 to 90% of the thickness of a liquid core by at least a pair of rolls in an unsolidified region of slab with a center solid fraction of 0.1 to 0.4.

The method proposed in Patent Literature 5 is a continuous casting method for reducing a slab with a liquid core, including: electromagnetically stirring unsolidified molten steel at a position in a curved region or bent region of a continuous casting machine where the angle between a tangent line of a circular arc formed by the curved region or bent region and the horizontal plane is 30° or more; installing reduction rolls in a horizontal region of the continuous casting machine at the downstream site from where the electromagnetic stirring is performed; and adjusting, in an area of a slab with a predetermined center solid fraction, the ratio of the amount of thickness reduction D1 to the thickness D2 of a liquid core during reduction to within 0.2 to 0.6.

The technique proposed in Patent Literature 6 relates to a continuous casting method of low-carbon steel, for electromagnetically stirring unsolidified molten steel and reducing a slab with a liquid core located on downstream of the electromagnetic stirring position, including: installing an electromagnetic stirrer at a distance of 3 to 7 m ahead of the most-upstream pair of reduction rolls to apply an electromagnetic force to the unsolidified molten steel so that the ratio of equiaxed structure be 6% or less, and reducing 40% or more of the thickness of a liquid core of the slab therewith, and also relates to a slab cast by the method.

Each of the above-mentioned techniques is the one for controlling the amount of equiaxed structure, existing in a path of discharging molten steel of a liquid core, by means of electromagnetic stirring in order to reduce a slab uniformly in thickness along a width-wise direction thereof and smoothly discharge segregation-elements-concentrated molten steel, and each technique exhibits an excellent effect.

As a result of further studies about a technique for stabilizing center segregation quality of a slab in continuous casting using the liquid core reduction rolling and the electromagnetic stirring, the prevent inventors made clear a problem that as a casting time becomes longer, the segregation-elements-concentrated molten steel as being discharged upstream of the reduction rolling position is enriched much more according to the time and consequently segregated at the tail end of a slab at high concentrations.

FIG. 1 is a view schematically showing the flow of molten steel in the continuous casting involving a liquid core reduction rolling disclosed in Patent Literature 2 or Patent Literature 5. The occurrence of high-concentration segregation at the tail end of a slab, which is the above-mentioned problem, will be described using the same figure.

Molten steel poured into a mold 3 is cooled with spray water injected from the mold 3 and from a set of secondary cooling spray nozzles below it (not shown), and a solidified shell is formed from the outer surface side of the molten steel to yield a slab 8. The slab 8 is withdrawn while a liquid core is present therein, and reduced in thickness by reduction rolls 7 after electromagnetic stirring is imparted to the molten steel of the liquid core by an electromagnetic stirrer 9. The electromagnetic stirrer 9 is generally installed at a distance of 9 m upstream of a meniscus and at a distance of 12 m upstream, in the casting direction, of the reduction rolling position to control the ratio of equiaxed structure.

In the above-mentioned electromagnetic stirring method, the molten steel is caused to flow in a direction from one minor side of slab 8 toward the other minor side thereof while reversing the flowing direction at a predetermined time interval. Such a stirring flow pattern imparted by this electromagnetic stirring method will be hereinafter called "uni-directional alternating flow forming-type stirring".

In case of the uni-directional alternating flow forming-type stirring, as shown in FIG. 1, the molten steel flows in a major side direction of slab (in a width-wise direction of slab) shown by X1, and this flow runs into the other minor side of slab, whereby there are formed (1) a flow of molten steel directed to upstream in the casting direction in the vicinity of the minor side of slab (shown by f3 and f4 in the figure), (2) a flow of molten steel directed downstream in the casting direction in the vicinity of the minor side of slab (shown by f1 and f2 in the figure) and (3) associated flows of molten steel. The stirring direction of molten steel along a width-wise direction of slab is reversed relative to the direction shown by X1 after the lapse of a predetermined time.

In general, the above-mentioned electromagnetic stirrer 9 is positioned far away from the reduction rolling position, for example, at a distance of 12 m upstream, in the casting direction, of the reduction rolling position, since it is used to control the ratio of equiaxed structure, but not intended to dilute the segregation-elements-concentrated molten steel. Therefore, a stirring force sufficient enough for diluting concentrated elements is not imparted to the segregation-elements-concentrated molten steel, and segregation elements are gradually concentrated in the vicinity of minor sides of slab with the lapse of casting time.

FIG. 2 is a view schematically showing that the enrichment of elements takes place in the vicinity of minor sides at the tail end of slab. The longer the operation time of the continuous casting, the more notable the formation of these elements-enriched zones in the vicinity of minor sides. Therefore, there arise problems that in case of a steel grade which requires further strict control of segregation of elements, it becomes difficult to continue the continuous casting over a longer period of time, and the yield of the slab is reduced.

DISCLOSURE OF THE INVENTION

The technique for electromagnetically stirring unsolidified molten steel, which is conventionally performed to decrease the center segregation in continuous casting as described above, has following problems.

Namely, although segregation elements in segregation-elements-concentrated molten steel discharged by liquid core reduction rolling can be dispersed to some degree by the uni-directional alternating flow forming-type stirring, the electromagnetic stirrer is insufficient in the effect of dispersing and diluting the segregation elements, since the electromagnetic stirrer is installed at a position far distant from the reduction rolling position, and the formation of segregation-elements enriched zones is likely to occur in the vicinity of minor sides of slab. Since the formed enriched zones become more notable as the operation time of continuous casting becomes longer, it is difficult to produce a slab with sound segregation quality during long-time casting operation.

In view of such problems of the related art, the present invention is made, and the object of the present invention is to develop a technique for appropriately stirring segregation-elements-concentrated molten steel as being discharged upstream in a casting direction by a liquid core reduction rolling, in order to provide a continuous casting method capable of drastically improving the effect of diluting and stirring segregation elements and producing a slab with stabilized segregation quality even in a long-time continuous casting operation, and an electromagnetic stirrer usable for the continuous casting method.

To solve the above-mentioned object, the present inventors earnestly studied and developed for a continuous casting method capable of drastically improving the stirring method of segregation-elements-concentrated molten steel as being discharged into unsolidified molten steel by the reduction rolling of slab, and producing a slab with stabilized center segregation quality over long-time continuous casting operation. As a result, following findings (a) to (e) could be obtained.

[Stirring Position of Segregation-Elements-Concentrated Molten Steel]

(a) The electromagnetic stirrer by uni-directional alternating flow forming-type stirring is generally installed at a distance of 12 m upstream, in casting direction, of the reduction rolling area of slab to control the ratio of equiaxed structure. According to the present inventors' examinations, such an electromagnetic stirrer is insufficient for the effect of diluting the segregation elements enriched portions in the vicinity of minor sides of slab. In order to improve this, it is necessary to install the electromagnetic stirrer at a position further nearer to the reduction rolling position of the slab.

The present inventors examined, by a macro-structure check of a slab that is freed from liquid core reduction rolling on the way, the distance how far the segregation-elements-concentrated molten steel as being discharged by the reduction rolling of the slab with a liquid core flows back upstream. From the result, since the maximum upstream flow-back distance of the segregation-elements-concentrated molten steel is about 9 m, it was found to be desirable to install the electromagnetic stirrer at a position of 9 m or less upstream, in the casting direction, of the reduction rolling position.

[Stirring Flow Pattern]

(b) The segregation-elements-concentrated molten steel as being discharged into unsolidified molten steel is pushed back to the reduction rolling position even if stirred in casting direction, since it is distributed to spread upstream of the reduction rolling position, and the stirring in casting direction is thus poor for the effect of diluting and stirring segregation elements. Accordingly, stirring in a width-wise direction of slab is effective for the segregation-elements-concentrated molten steel.

The uni-directional alternating flow forming-type stirring can be adopted as the stirring in a width-wise direction of slab, and installed in an appropriate position for diluting the segregation-elements-concentrated molten steel. In this case, the segregation-elements-concentrated molten steel runs into a minor side of slab while diluted by the stirring flow in a width-wise direction of mold, and then separated into flows directed upstream and downstream, in the casting direction, along the minor side of slab.

The resultant upstream flow is mixed and diluted with the upstream molten steel that is not concentrated, while the resultant downstream flow is pushed back to the reduction rolling position. Thus, if the stirring force is insufficient, the downstream flow can be insufficiently diluted and form the segregation-elements enriched zones. Therefore, when the uni-directional alternating flow forming-type stirring is adopted, a large stirring force is needed to suppress the formation of segregation-elements enriched zones.

Further, for decreasing the concentration of molten steel along the minor sides of slab, it is effective to impart a stirring flow, as shown in FIG. 3 to be described, which causes molten steel to flow from both minor sides of slab to the width-wise central position of slab to thereby collide with each other in the vicinity of the central position (hereinafter referred also to as "collision flow forming-type stirring").

Although the flows of molten steel flowing in casting direction in the vicinity of minor sides of slab occur also in this collision flow forming-type stirring, this stirring is characterized in that flows of molten steel directed upstream and downstream in the casting direction can be formed also in the vicinity of the width-wise central position. Therefore, the collision flow forming-type stirring can further decrease the segregation-elements enriched portions at the tail end of slab by the effect of sweeping segregation-elements-concentrated molten steel in the vicinity of the minor sides, compared with the uni-directional alternating flow forming-type stirring.

Further, since the number of upward and downward flows in the casting direction of molten steel, which was two in the uni-directional alternating flow forming-type stirring, can be increased to three in the collision flow forming-type stirring, a simple calculation suggests that it becomes possible to decrease the degree of accumulation of segregation-elements-concentrated molten steel to two-thirds of the former.

[Configuration of Electromagnetic Stirrer and Selectiveness of Stirring Flow Patterns]

(c) To attain the collision flow forming-type stirring described in (b), it is appropriate to use an electromagnetic stirrer located upstream, in the casting direction, of a reduction rolling position of a slab with a liquid core, the electromagnetic stirrer comprising an iron core which has its longitudinal axis along a width-wise direction of slab, the outer circumference of the iron core being wound by a plurality of exciting coils about the longitudinal axis of the iron core, in which phases of current in the exciting coils are distributed symmetrically with respect to the iron core center position, corresponding to the width-wise center position of slab, along a longitudinal direction of the iron core by passing two-phase or three-phase alternating current through the exciting coils as shown in after-mentioned FIGS. 8 and 9.

On the other hand, to cope with various casting conditions or steel grades, it is needed to use an electromagnetic stirrer that can selectively adopt the uni-directional alternating flow forming-type stirring in addition to the collision flow forming-type stirring. In this case, it is appropriate to distribute the phase of current of the exciting coil in such a manner that the phase of current of the exciting coils at one width-wise end portion of iron core increases or decreases by 90 or 60° sequentially from that at the other width-wise end portion According to this, the collision flow forming-type stirring and the uni-directional alternating flow forming-type stirring can be attained using the same electromagnetic stirrer.

[Adjustment of Thickness Reduction Rate of Liquid Core Based on Amount of Superheat of Molten Steel]

(d) The thickness reduction rate of a liquid core of a slab is adjusted according to the amount of superheat (ΔT) of molten steel in a tundish to surely discharge concentrated molten steel and also surely achieve pressure bonding of a solidified shell: in addition, the length (W), in a slab width-wise direction, of each of segregation zones is set so as to satisfy relationships represented by the following expressions (1A) and (1B), the segregation zones existing at both width-wise end portions of the slab and having an elements-segregation ratio (C/Co) of 0.80 to 1.20, the segregation ratio being obtained by dividing an instant element concentration (C) by an average element concentration (Co); whereby a slab with stabilized center segregation quality can be produced over a long-time casting operation.

$$0 \leqq W \leqq 0.2 \times W1 \quad (1A)$$

$$W1 = (Wo - 2 \times d) \quad (1B)$$

wherein Wo represents the width of slab, W1 represents the length of a liquid core, in a width-wise direction of slab, at a reduction rolling position of the slab, and d represents the thickness of a solidified shell on a minor side of slab at the reduction rolling position of the slab.

(e) The amount of superheat (ΔT) of molten steel in a tundish in above-mentioned (d) can be set to 25 to 60° C. When the amount of superheat is below 25° C., a solidified shell on the minor sides of slab cannot be sufficiently reduced in thickness. On the other hand, when the amount of superheat exceeds 60° C., a solidified shell within the mold becomes thin, and the rupture of a solidified shell may occur at the lower end region of the mold. Accordingly, the casting speed is obliged to be decreased to avoid this.

The present invention is accomplished based on the above-mentioned findings, and the gist of the present invention is a continuous casting of steel shown in (1) to (3) described below, and an electromagnetic stirrer shown in (4) and (5) below.

(1) A continuous casting method of steel in which an electromagnetic stirrer is installed upstream, in casting direction, of a reduction rolling position of a slab, and in which a slab with a liquid core is reduced in thickness, including:

selectively imparting, by means of the electromagnetic stirrer, a stirring flow which causes molten steel to flow from both minor sides of the slab toward the width-wise center of slab and collide with each other in the vicinity of the width-wise center of slab, and a stirring flow which causes molten steel to flow from one minor side of slab toward the other minor side thereof while reversing the flowing direction at a predetermined time interval.

(2) In the above-mentioned continuous casting method in (1), it is desired to install at least one electromagnetic stirrer at a distance of 9 m or less upstream, in the casting direction, of the reduction rolling position of the slab.

(3) In the above-mentioned continuous casting method in (1) and (2), it is further preferable that the thickness reduction rate of the slab is adjusted according to the amount of superheat (ΔT) of molten steel in a tundish, and that the length (W), in a slab width-wise direction, of each of segregation zones is set within the range satisfied by a relationship represented by the following expression (1), the segregation zone having a segregation-elements ratio of 0.80 to 1.20 and existing at both width-wise-end portions of and in the thickness-wise central portions of slab:

$$0 \leqq W \leqq 0.2 \times (Wo - 2 \times d) \quad (1)$$

wherein W represents the length, in a slab width-wise direction, of each of segregation zones existing at both width-wise end portions of slab (mm), Wo represents the width of the slab (mm), and d represents the thickness of a solidified shell on a minor side of slab at the reduction rolling position of the slab (mm).

(4) An electromagnetic stirrer of molten steel to be disposed upstream, in the casting direction, of a reduction rolling position of a slab with a liquid core to stir molten steel of the liquid core in a width-wise direction of slab, comprising:

an iron core having its length-wise axis along a width-wise direction of slab; and a plurality of exciting coils which are wound around the outer circumference of and about the longitudinal axis of the iron core, in which two-phase or three-phase alternating current is passed through the exciting coils, and when imparting a stirring flow which causes molten steel to flow from both minor sides of slab toward the width-wise center of slab so as to collide with each other in the vicinity of the width-wise center of slab, the phases of current in the exciting coils are distributed symmetrically with respect to the iron core length-wise center corresponding to the width-wise center of slab along a longitudinal direction of the iron core, when imparting a stirring flow which causes molten steel to flow from one minor side of slab toward the other minor side thereof while reversing the flowing direction at a predetermined interval, the phases of current in exciting coils are distributed in such a manner that the phase of current of exciting coils at one width-wise end portion of iron core increases or decreases by 90 or 60° sequentially from that at the other width-wise end portion, and the stirring flow is selectively imparted.

(5) In a continuous casting apparatus in the above-mentioned (1), it is preferable to install at least one electromagnetic stirring device at a distance of 9 m or less upstream, in the casting direction, of the reduction rolling position of the slab.

DEFINITIONS AND MEANINGS OF TERMS

In the present invention, the "disposed with its longitudinal axis being along a width-wise direction of slab" means that the longitudinal axis of the iron core is set to form an angle within ±5° relative to a width-wise direction of slab (a right-angled to the casting direction).

The "elements-segregation ratio" means a ratio obtained by dividing an instant element concentration C (mass %) such as C, Mn, P, S in an arbitrary position of a slab by an average element concentration Co (mass %), and the mass % may be shown simply also as %.

The "amount of superheat of molten steel" means a temperature difference obtained by subtracting a liquid phase line temperature determined from an equilibrium diagram or the like from an actually measured temperature of molten steel.

The "center solid fraction" means a fraction of solid phase relative to the total of solid phase and liquid phase in the central portion of slab.

In the descriptions of the present specification of application, the "uni-directional alternating flow forming-type stirring" means a stirring flow which causes molten steel to flow from one minor side of slab to the other minor side thereof while reversing the flowing direction at a predetermined time interval.

The "collision flow forming-type stirring" means a stirring flow which causes molten steel to flow from both minor sides of slab to the width-wise center of slab and collide with each other in the vicinity of the width-wise center of slab.

EFFECT OF THE INVENTION

According to the continuous casting method of the present invention, an electromagnetic stirrer is installed upstream, in the casting direction, of the reduction rolling position of a slab, desirably, at a distance of 9 m or less upstream thereof, and continuous casting is performed while imparting a plurality of stirring flow patterns by means of the same electromagnetic stirrer. Thus, the collision flow forming-type stirring and the uni-directional alternating flow forming-type stirring can be selectively imparted to dilute and disperse segregation-elements-concentrated-molten steel, and a slab with stabilized center segregation quality can be produced even in a long-time continuous casting operation.

Further, according to the continuous casting method of the present invention, the above-mentioned expression (1) is satisfied by adjusting the targeted thickness reduction rate of a liquid core of a slab according to the amount of superheat of molten steel. Consequently, the length, in a slab width-wise direction, of each of segregation zones existing at both width-wise end portions, of slab can be decreased to 20% or less of the length of unsolidfied molten steel, in a slab width-wise direction. Therefore, a stable slab with minimized center segregation can be produced over a long-time continuous casting operation.

A basic structure adopted by the electromagnetic stirrer of the present invention comprises an iron core disposed in a width-wise direction of slab, and a plurality of exciting coils wound around the iron core. Two-phase or three-phase alternating current is passed through the exiting coils. When imparting the collision flow forming-type stirring, the phases of current in exciting coils are distributed symmetrically, with respect to an iron core center position corresponding to the width-wise center position of slab, along a longitudinal direction of the iron core. When imparting the uni-directional alternating flow forming-type stirring, the phases of current in exciting coils can be distributed in such a manner that the phase of current of exciting coils at one width-wise end portion of iron core increases or decreases by 90 or 60° sequentially from that at the other width-wise end portion. Since stirring flow patterns can be selectively used due to the basic structure, it is effective for the decrease in facility and equipment costs or improvement in maintainability.

According to the electromagnetic stirrer of the present invention, an effect of diluting concentrated molten steel by means of a further strong stirring flow can be obtained by installing a plurality of electromagnetic stirrers. Additionally, a stirring flow pattern suitable for an intended steel grade or size of a slab can be selected since the collision flow forming-type stirring and the uni-directional alternating flow forming-type stirring can be freely imparted during continuous casting.

Therefore, by adopting the continuous casting method and electromagnetic stirrer of the present invention, an excellent effect can be exhibited, particularly, in production of high-strength steel with high crack susceptibility or a slab for a steel grade suitable for an extremely thick plate product with a thickness of 100 mm or more.

BEST MODE FOR CARRYING OUT THE INVENTION

As described above, the present invention provides a continuous casting method of steel, in which an electromagnetic stirrer is installed upstream, in the casting direction, of a reduction rolling position of a slab, and in which a slab with a liquid core is reduced in thickness, wherein the collision flow forming-type stirring and the uni-directional alternating flow forming-type stirring are selectively imparted. Further, at least one electromagnetic stirrer is desirably installed at a distance of 9 m or less upstream, in the casting direction, of the reduction rolling position of the slab.

In the present invention, it is further desirable to adjust the thickness reduction rate of a slab according to the amount of superheat ($\Delta T$) of molten steel in a tundish and to set the length (W), in a width-wise direction of slab, of each of segregation zones with an elements-segregation ratio of 0.80 to 1.20, which exist in the thickness-wise central part at each of width-wise end portions of the slab, so as to satisfy a predetermined relation.

The present invention provides an electromagnetic stirrer provided with a configuration capable of selectively imparting the collision flow forming-type stirring and the uni-directional alternating flow forming-type stirring for carrying out the above-mentioned continuous casting method of the present invention.

In case of carrying out the present invention, even a conventional electromagnetic stirrer in common use, for example, a stirrer disposed to control the ratio of equiaxed structure can further promote the dilution and mixing of segregation-elements-concentrated molten steel. Accordingly, it is desirable that such an ordinary electromagnetic stirrer is installed upstream of the position where the electromagnetic stirrer of the present invention is disposed, and use the ordinary electromagnetic stirrer to promote the dilution and mixing of segregation-elements-concentrated molten steel.

The continuous casting method and the electromagnetic stirrer of the present invention will be then described in detail.

1. "Collision Flow Forming-Type Stirring" and Effect Thereof

In the continuous casting method of the present invention, stirring flow patterns of molten steel exert an important action. The "collision flow forming-type stirring" of the stirring flow patterns will be described hereinafter.

Figure 3:
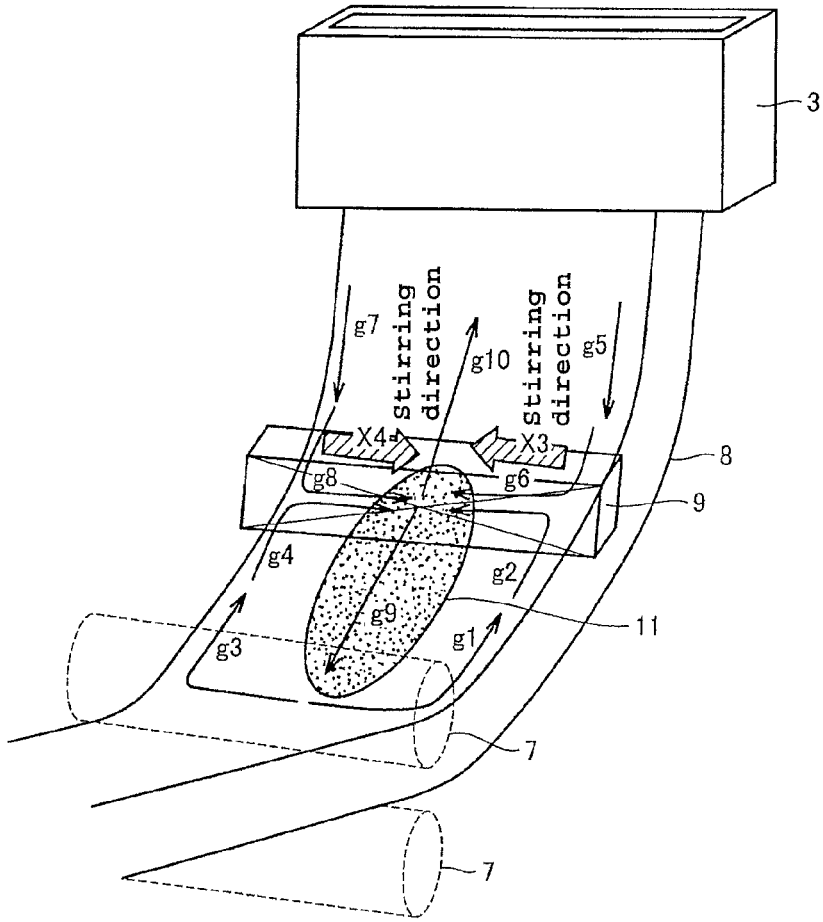
FIG. 3 is a view schematically showing the flow of molten steel of a liquid core in a casting method of the present invention.

FIG. 3 is a view schematically showing the flow of molten steel of a liquid core in the casting method of the present invention. Molten steel poured into a mold 3 is cooled, and a solidified shell is formed from the outside surface of the molten steel to yield a slab 8. The slab 8 having the liquid core therein is withdrawn downwardly, and reduced in a thickness-wise direction, by reduction rolls 7 after electromagnetic stirring is imparted to molten steel of the liquid core by an electromagnetic stirrer 9.

In the continuous casting method of the present invention, the electromagnetic stirrer 9 forms flows of molten steel directed from both minor sides of slab to the width-wise center of slab. Namely, flows of molten steel g2 and g4, and associated flows of molten steel g1 and g3 are formed downstream, in the casting direction, of the stirrer's position, and flows of molten steel g6 and g8 and associated flows of molten steel g5 and g7 are formed upstream, in the casting direction, of the stirrer's position. The flows of molten steel g2 and g6 and the flows of molten steel g4 and g8 collide with each other in the vicinity of the width-wise center of slab to form a flow of molten steel g9 directed downstream in the casting direction and a flow of molten steel g10 directed upstream in the casting direction.

By imparting such a collision flow forming-type stirring, segregation-elements-concentrated molten steel which is likely to aggregate at both width-wise end portions of slab is caused to flow toward the vicinity of the width-wise center of the slab. The flows of segregation-elements-concentrated molten steel then collide against each other in the vicinity of the width-wise center and flows downstream in the casting direction in part and upstream in the casting direction in part, whereby the segregation-elements-concentrated molten steel is effectively diluted and dispersed. Accordingly, by imparting the collision flow forming-type stirring, the formation of elements (segregation elements) enriched zones in the vicinity of both minor sides of slab can be drastically decreased.

2. Electromagnetic Stirring Method

In order to attain the collision flow forming-type stirring, the present inventors made studies for a concrete stirring method through electromagnetic field simulation by numerical analysis. Firstly, the "uni-directional alternating flow forming-type stirring" will be described. Secondly, the "collision flow forming-type stirring" that is the object of the present invention, and thirdly, a configuration for attaining the uni-directional alternating flow-forming stirring which exhibits excellent stirring performance by means of the same electromagnetic stirrer will be described.

Figure 4:
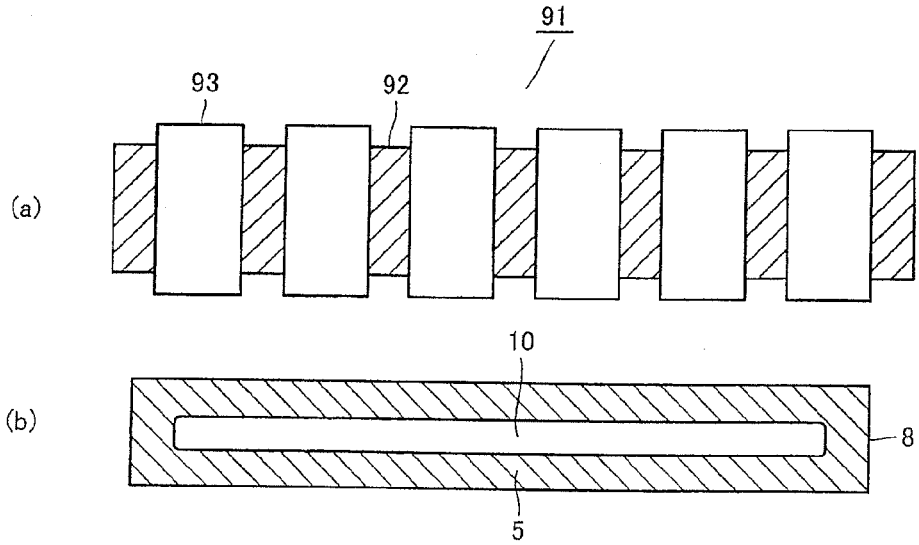
FIG. 4 are views schematically showing a relationship between an electromagnetic stirring coil and a transverse cross-section of a slab, wherein (a) shows the electromagnetic stirring coil and (b) shows the transverse cross-section of the slab.

2-1. "Uni-Directional Alternating Flow Forming-Type Stirring" and Formation Mechanism of Moving Magnetic Field FIG. 4 are views schematically showing a relationship between an electromagnetic stirring coil and a transverse cross-section of a slab, wherein (a) shows the electromagnetic stirring coil, and (b) shows the transverse cross-section of a slab. An electromagnetic stirring coil 91 has a structure in which a plurality of exciting coils 93 is wound about the longitudinal axis of an iron core 92 formed of stacked electromagnetic steel sheets. Two-phase or three-phase alternating current is applied to this electromagnetic stirrer, varying the phase of current.

Figure 5:
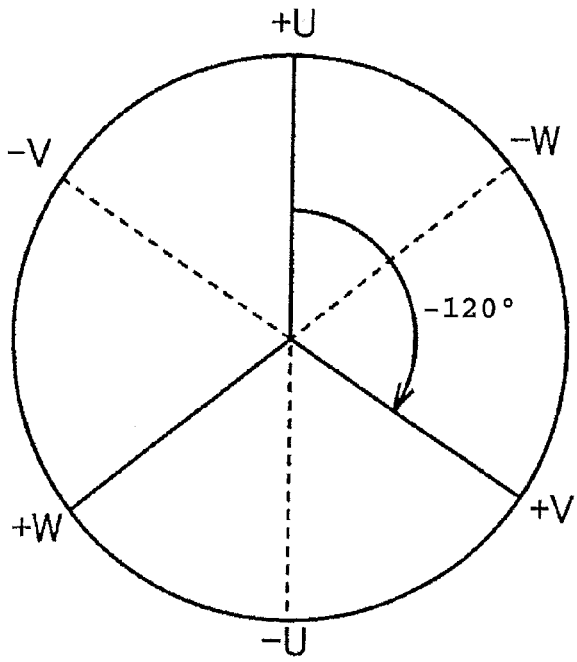
FIG. 5 is a view schematically showing phases of three-phase alternating current.

FIG. 5 is a view schematically showing phases of the three-phase alternating current. The uni-directional alternating flow forming-type stirring can be performed by generating a magnetic field which moves in a major side direction (width-wise direction) of slab. Concretely, currents having phases shown in FIG. 5 to be clockwise, are applied to the exciting coils shown in FIG. 4 in the order of coil from left to right. Namely, the application is performed in the order of +U phase, −W phase, +V phase, −U phase, +W phase, and −V phase. The stirring direction can be reversed by, counter-clockwise, applying currents having phases shown in FIG. 5, to the exciting coils shown in FIG. 4 in the order of coil from left to right. Namely, the application is performed in the order of +U phase, −V phase, +W phase, −U phase, and so on.

A mechanism in which a moving magnetic field is generated by applying currents having the phases as described above will be then described.

Figure 6:
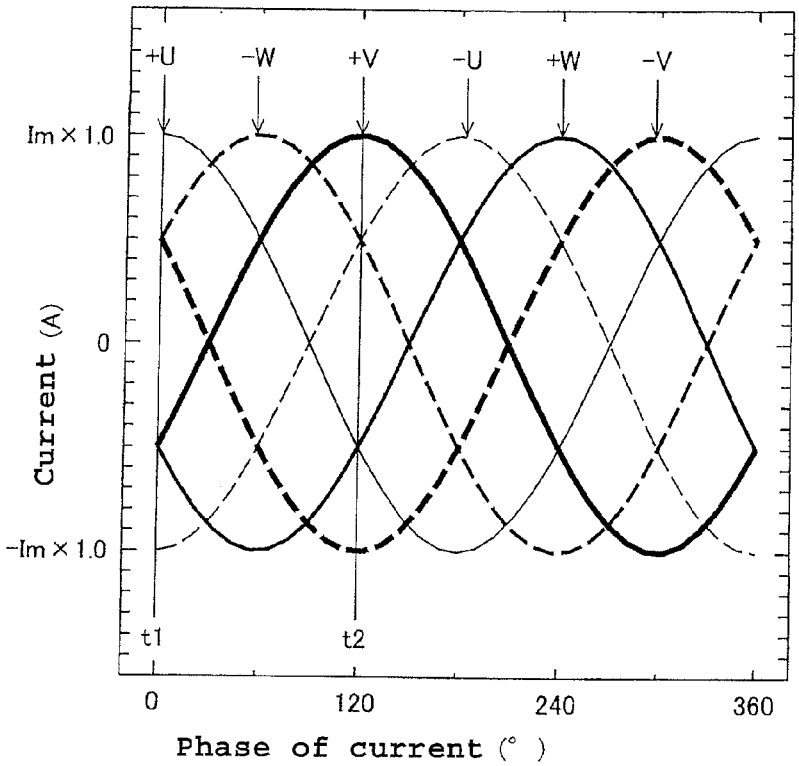
FIG. 6 is a graph showing variations of current value with time in the three-phase alternating current.
Figure 7:
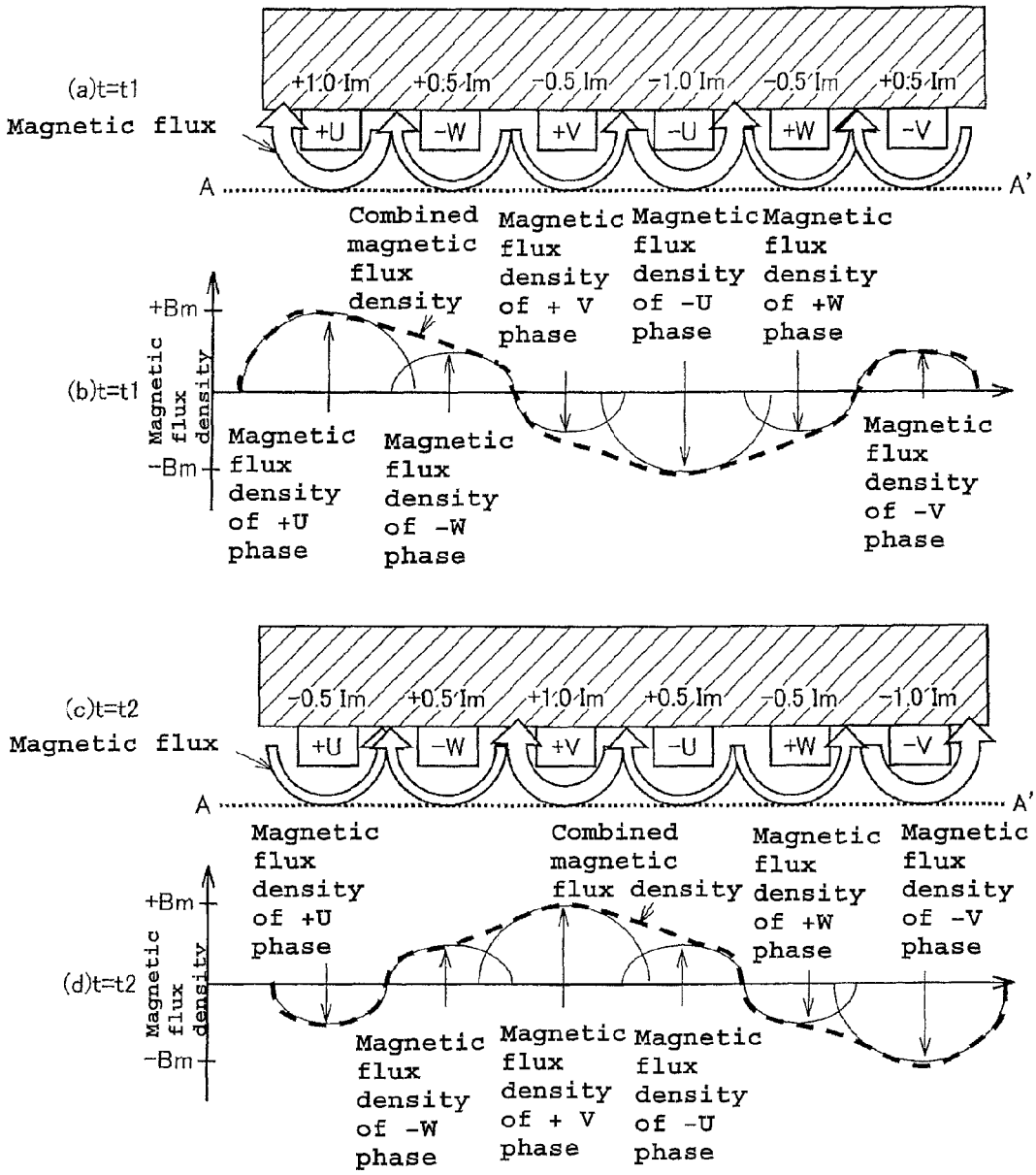
FIG. 7 are views for illustrating a mechanism for formation of moving magnetic field, wherein (a) schematically shows current values in exciting coils and a distribution of magnetic flux at time t1, (b) schematically shows a distribution of magnetic flux density at time t1, (c) schematically shows current values in the exciting coils and a distribution of magnetic flux at time t2, and (d) schematically shows a distribution of magnetic flux density at time t2.

FIG. 6 is a graph showing variations of the current value with time in the three-phase alternating current. FIG. 7 are views for illustrating a formation mechanism of a moving magnetic field, wherein (a) schematically shows the current value in each exciting coil and a distribution of magnetic flux around it at time t1, (b) schematically shows a distribution of magnetic flux density at a position away from the electromagnetic coil by a certain distance (on line A-A' in (a)) at time t=t1, (c) schematically shows the current value in each exciting coil and a distribution of magnetic flux around it at time t=t2, and (d) schematically shows a distribution of magnetic flux density on line A-A' in (c) at time t=t2. (a) and (c) of FIG. 6 schematically show an electromagnetic coil having six exciting coils wound around its iron core as shown in FIG. 4, showing only the slab-side periphery of the coil.

In the above-mentioned FIG. 6 which shows the temporal change of current value, the amplitude of alternating current is Im. The three-phase alternating current is an alternating current in which +U phase, +V phase and +W phase are shifted by 120°, respectively, in this order, and when −U phase, −V phase and −W phase reversed in current direction are also taken into consideration, an alternating current with a phase difference of 60° each as shown in FIGS. 5 and 6 can be used also.

As to the passing direction of current, the passing direction from the sheet face to its back face is taken as positive. A clockwise magnetic flux is generated around an exciting coil when current passes in the positive direction. And a counter-clockwise magnetic flux is generated when current passes in the reverse direction. The magnitude of magnetic flux density increases according to the increase in the current value in an exciting coil.

At time t=t1, as shown in FIG. 7(*a*), current of +1.0+Im passes through +U phase exciting coil on the leftmost side, current of +0.5×Im passes through −W phase exciting coil on the right-hand side of the leftmost exciting coil, and currents of −0.5×Im, −1.0×Im, −0.5×Im and +0.5×Im pass through the exciting coils of +V phase, −U phase, +W phase and −V phase respectively. As a result, magnetic fluxes as shown in the same figure are generated in the vicinity of each winding coil.

Consequently, at time t=t1, a distribution of magnetic flux density as schematically shown in FIG. 7(*b*) is formed at a position away from the electromagnetic coil by a certain distance (on line A-A' in FIG. 7(*a*)). FIG. 7(*b*) schematically shows the distribution of the magnetic flux density generated by each of exciting coils and the resultant distribution of the magnetic flux density obtained by combining them. In the same figure, the maximum value of magnetic flux density which is generated on the line A-A' when the current value in an exciting coil is +1.0×Im is shown as +Bm.

Similarly, the magnetic flux densities generated by the respective exciting coils at time t=t2 based on the current passed through each exciting coil and the resultant distribution of magnetic flux density obtained by combining them are schematically shown, respectively, in FIGS. 7(*c*) and (*d*). At time t=t2, the phase is advanced 120° from that at time t=t1. The phase difference of 120° corresponds to (1/f)×(120/360) seconds (wherein f is the frequency of current (Hz)) in terms of time.

Accordingly, it is found from the comparison between FIGS. 7(*b*) and (*d*) that the distribution of magnetic flux density moves a length corresponding to two intervals of equally-spaced coils from left to right during the passage of time from t1 to t2. Namely, the formation of a moving magnetic field which moves from left to right along a longitudinal direction of iron core is demonstrated.

Figure 1:
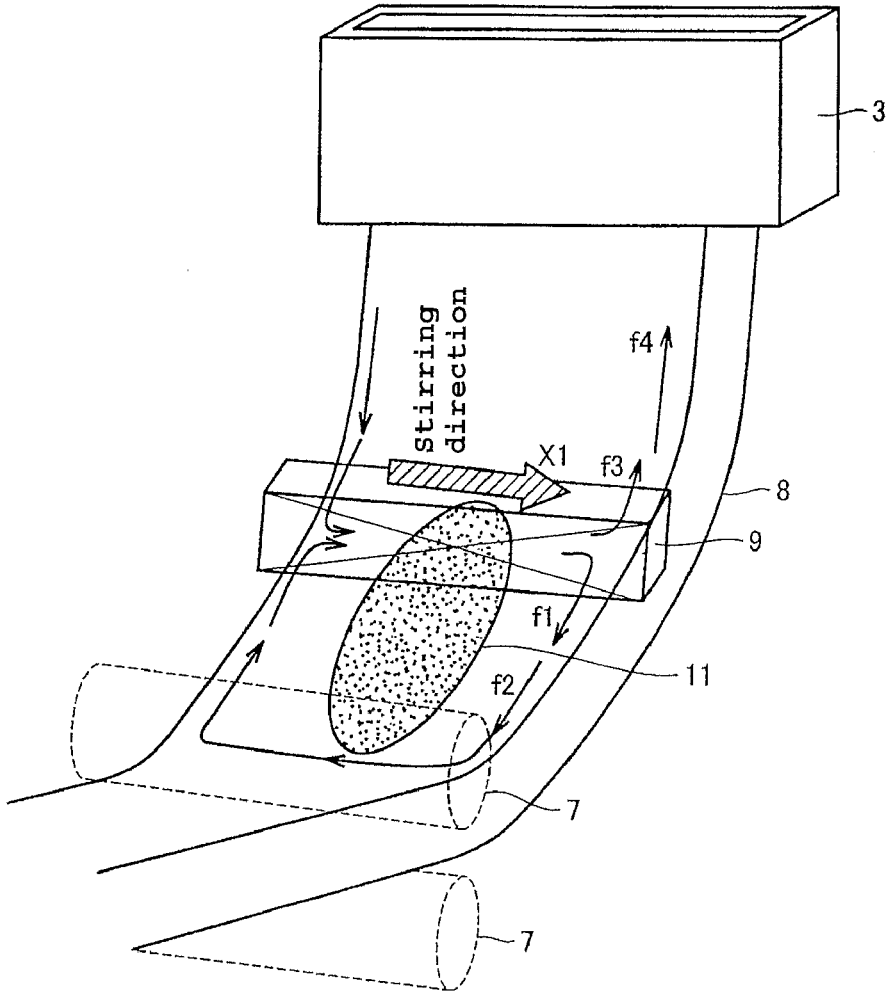
FIG. 1 is a view schematically showing the flow of molten steel in a conventional continuous casting method involving a liquid core reduction rolling.
Figure 2:
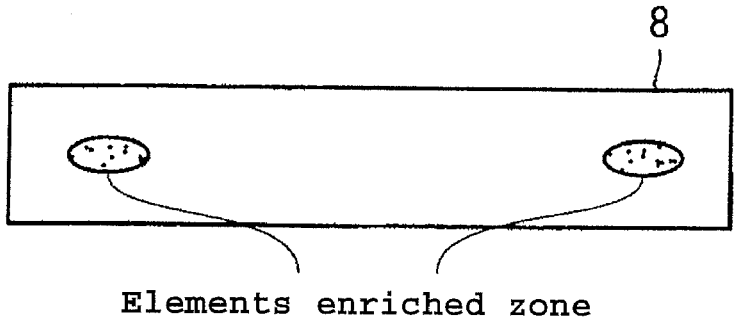
FIG. 2 is a view schematically showing the enrichment of elements in the vicinity of minor sides of slab cast by the related art.

Due to the movement of the magnetic field from left to right along a longitudinal direction of iron core as described above (that is, the movement of the magnetic field from one minor side of slab to the other minor side thereof), an induction current is generated in molten steel, and a force that this induction current receives from the magnetic field (Lorentz force) drives the molten steel to flow following the moving direction of the magnetic field, and the molten steel flows in the direction shown by the arrow X1 in FIG. 1. Thereafter, the molten steel flows oppositely to the direction shown by the arrow X1 by reversing the moving direction of the magnetic field after a predetermined time, whereby a uni-directional alternating flow is formed.

2-2. Selection of "Collision Flow Forming-Type Stirring" and "Uni-Directional Alternating Flow Forming-Type Stirring" of the Present Invention The present inventors further made research and development based on the formation mechanism of a moving magnetic field described in 2-1, and consequently obtained the following findings.

Namely, it was found that by applying currents of +U phase, −W phase and +V phase from left to right, respectively, to the left half set of the exciting coils in a longitudinal direction of iron core in FIG. 4, and applying currents of +U phase, −W phase and +V phase from right to left, respectively, to the right half set of the exciting coils of the iron core, a moving magnetic field directed from left to right and a moving magnetic field directed from right to left can be formed in the left half of the iron core and in the right half thereof, respectively.

Namely, the collision flow forming-type stirring can be attained by distributing, when the iron core of the electromagnetic stirrer is disposed with its longitudinal axis along a width-wise direction of slab, the phase of the current applied to each exciting coil symmetrically with respect to an iron core center corresponding to the width-wise center of slab and along a longitudinal direction of iron core.

The finding (c) described previously is obtained from the above-mentioned study.

2-3. Analysis of Distribution of Electromagnetic Force by Numerical Simulation (Uni-Directional Flow Forming-Type Stirring in the Present Invention)

Firstly, a distribution of electromagnetic force for performing the uni-directional flow forming-type stirring of molten steel was analyzed. The analysis was performed by applying three-phase alternating current with a phase difference of 120° each to exciting coils under conditions of a current value of 75600 A·Turn and a frequency of 1.3 Hz in exciting coils.

Figure 8:
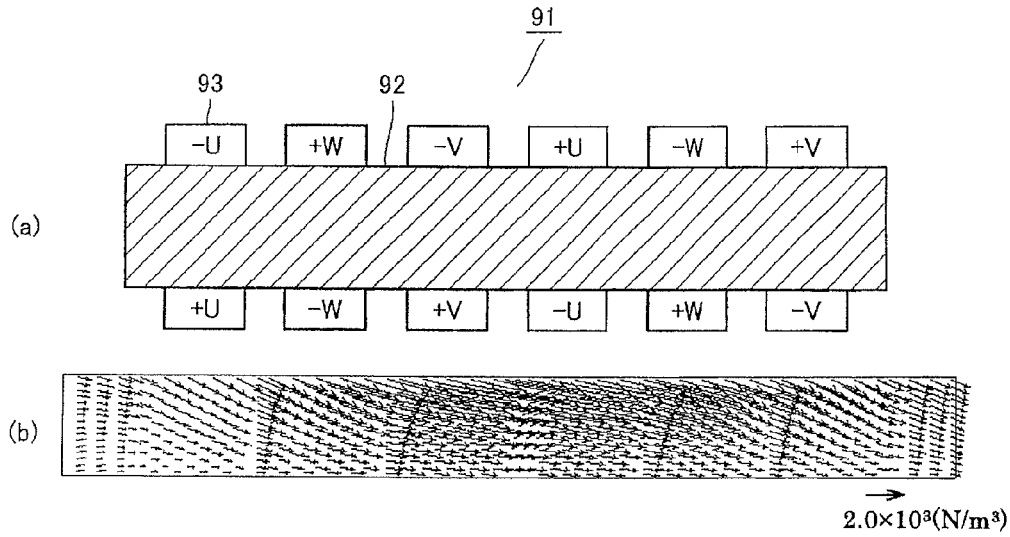
FIG. 8 are views showing a distribution of electromagnetic force in an uni-directional alternating flow forming-type electromagnetic stirring method, the distribution being determined by numerical simulation, wherein (a) shows the phases of current in an electromagnetic stirring coil, and (b) shows a distribution of electromagnetic force within a transverse cross-section of a slab.

A distribution of electromagnetic force in uni-directional flow forming-type stirring which is determined by numerical simulation is shown in FIG. 8. As a result of application of currents of +U phase, −W phase, +V phase, −U phase, +W phase and −V phase to each exciting coil, starting from the left, respectively, as shown in (a) of the same figure, a direction and a distribution of magnitude of electromagnetic force for attaining the uni-directional flow forming-type stirring directed from the left minor side of slab to the right minor side thereof were obtained as shown in (b) of the same figure.

[Collision Flow Forming-Type Stirring in the Present Invention]

Then, a distribution of electromagnetic force for attaining the collision flow forming-type stirring was determined. The simulation was performed by applying three-phase alternating current with a phase difference of 120° each to exciting coils under conditions of a current value of 75600 A·Turn and a frequency of current of 1.3 Hz in exciting coils.

Figure 9:
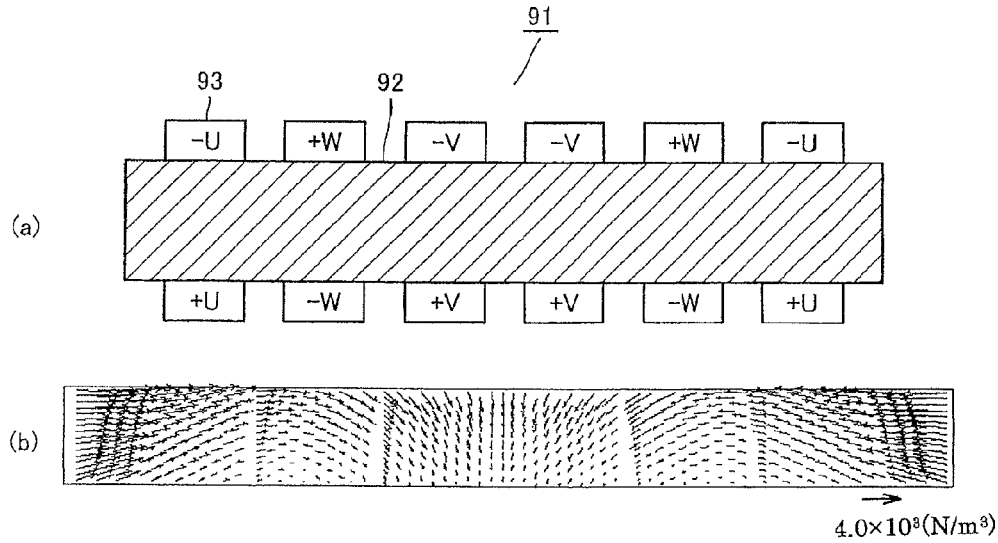
FIG. 9 are views showing a distribution of electromagnetic force obtained by an electromagnetic stirring method using three-phase alternating current adopted in the continuous casting method of the present invention, the distribution being determined by numerical simulation, wherein (a) shows phases of current in an electromagnetic stirring coil, and (b) shows a distribution of electromagnetic force within a transverse cross-section of a slab.

FIG. 9 are views showing a distribution of electromagnetic force in the collision flow forming-type stirring adopted in the continuous casting method of the present invention, wherein (a) shows the phases of current in the electromagnetic stirring coil, and (b) shows the direction and distribution of magnitude of electromagnetic force within a transverse cross-section of a slab.

As shown in the same figures, it was found that the distribution of electromagnetic force for attaining the collision flow forming-type stirring, or the distribution of electromagnetic force directed from the vicinity of the minor sides of slab to the width-wise central portion of slab is obtained by distributing phases of current applied to exciting coils symmetrically, with respect to the length-wise center of iron core corresponding to the width-wise center of slab, along a longitudinal direction of iron core.

Figure 10:
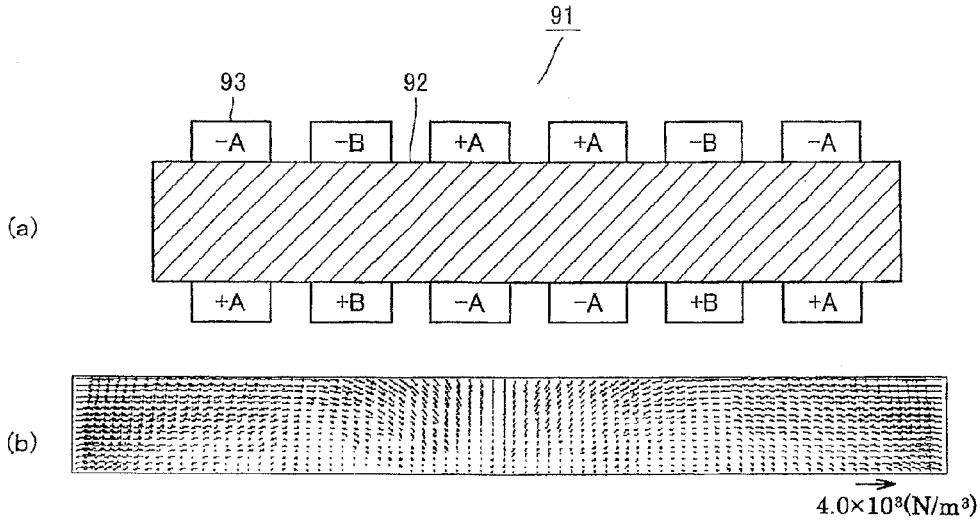
FIG. 10 are views showing a distribution of electromagnetic force obtained by an electromagnetic stirring method using two-phase alternating current adopted in the continuous casting method of the present invention, the distribution being determined by numerical simulation, wherein (a) shows phases of current in an electromagnetic stirring coil, and (b) shows a distribution of electromagnetic force within a transverse cross-section of a slab.

FIG. 10 are views showing a distribution of electromagnetic force for attaining the collision flow forming-type electromagnetic stirring adopted in the continuous casting method of the present invention by means of two-phase alternating current, wherein (a) shows a distribution of phases of current in the electromagnetic stirring coil, and (b) shows a distribution of electromagnetic force within a transverse cross-section of a slab. In the numerical simulation for the same figures, two-phase alternating current having phase A and phase B with a phase difference of 90° between each other was applied.

As shown in the same figures, the distribution of electromagnetic force for attaining the collision flow forming-type stirring can be obtained by distributing phases of current of the two-phase alternating current to be applied to exciting coils symmetrically, with respect to the length-wise center of iron core corresponding to the width-wise center of slab, along a length-wise direction of the iron core.

It can be found from the comparison of the results of FIGS. 9 and 10 that a strong stirring flow can be imparted to molten steel by using the three-phase alternating current, since the electromagnetic force when three-phase alternating current is used (the distribution shown in FIG. 9) is larger than that when two-phase alternating current is used (the distribution shown in FIG. 10).

With respect to the uni-directional flow forming-type stirring, also, it was confirmed that a strong stirring flow can be imparted to molten steel by using the three-phase alternating current, since the electromagnetic force when three-phase alternating current is used is larger than that when two-phase alternating current is used.

3. Desirable Embodiment of the Present Invention

3-1. Conditions of Electromagnetic Stirring

An exciting coil larger in the number of turns and larger in sectional area is more preferable since the stirring force becomes larger as the value of current applicable to the exciting coil becomes larger. However, when six exciting coils are installed, for example, the width of turns of each exciting coil is limited by the length of the iron core since each exciting coil must be spaced at intervals of about 50 mm.

Namely, when the interval between exciting coils is 50 mm, the maximum value of the width of turns per exciting coil is (L-50×5)/6 (mm), wherein L is the length of an iron core (mm). It is preferable that the optimum length of an iron core is slightly smaller than the width of a slab since it is considered to be substantially equal to the width of liquid core at the position where the electromagnetic coil is disposed. When the width of a slab is 2260 mm, and the length of an iron core is 2000 mm, the width of turns for each coil is (2000−50×5)/6=292 mm.

The limitation of the width of turns for exciting coils obliges to increase in the number of turns in a circumferential relation to the iron core to ensure the number of turns of coil. However, nor can the number of turns be circumferentially increased without limitation, since the increase in the number of turns in a circumferential relation to the iron core results in an increased distance between the iron core and a slab due to the winding thickness/depth of the coil.

As a result of studies for appropriate width and thickness/depth of turns in each exciting coil from numerical simulation in consideration of the above, it was found that a preferable width of turns in exciting coils is about 200 to 300 mm, and a preferable thickness thereof is about 40 to 100 mm.

The accuracy of the alternating current to be applied to the exciting coils can be in the range such that the anteroposterior relation of the phase difference 60° in current is never reversed, that is, in the range such that the accuracy of the phase difference is within ±20°. Although the waveform of the current may be a general sine wave, a current having a square or triangular pulse waveform can be adopted also without problems.

A desirable range of the frequency of alternating current will be then described. As the frequency of alternating current is increased, the Lorentz force is increased in strength, but decreased in penetration depth. Therefore, it is considered that preferable frequency has a penetration depth that corresponds to about 250 to 300 mm of the thickness of slab. The penetration depth δ (m) is represented by the following equation (2), wherein σ conductivity, μ is magnetic permeability, and f is frequency.

$$\delta=\{1/(\pi\sigma\mu f)\}^{1/2} \quad (2)$$

Given that molten steel and steel have substantially similar values of conductivity and magnetic permeability, that is, $\sigma=7.14\times10^5$ S/m and $\mu=4\pi\times10^{-7}$ N/A$^2$ around a solidification point of steel, the frequency f which provides a penetration depth δ (m) equal to or more than the above-mentioned thickness of slab is 4 to 5 Hz or less. However, it is desirable to set the frequency to about 1 to 4 Hz for practical purposes since a higher frequency requires a larger capacity of power.

3-2. Preferred Embodiment of the Present Invention

In the present invention, as described previously, the length (W), in a slab width-wise direction, of each of segregation zones is preferably set within the range satisfied by relationships represented by the following expressions (1A) and (1B), the segregation zones remaining in the thickness-wise central part at both width-wise end portions of slab and having an elements-segregation ratio (C/Co) of 0.80 to 1.20, the elements segregation ratio being obtained by dividing an instant element concentration (C) at an arbitrary position by the average element concentration (Co).

$$0\leqq W\leqq 0.2\times W1 \quad (1A)$$

$$W1=(Wo-2\times d) \quad (1B)$$

wherein W represents the length (mm), in a slab width-wise direction, of each of segregation zones existing at both width-wise end portions of slab, Wo represents the width of slab (mm), and d represents the thickness of a solidified shell on a minor side of slab at a reduction rolling position of the slab (mm).

The following is the reason for setting the elements-segregation ratio of (C/Co) to be in the range of 0.80 to 1.20 for determining the length (W) of each of segregation zones at the width-wise end portions of slab. The present inventors perform MA analysis on Mn to evaluate the segregation ratio, an equilibrium distribution coefficient of Mn being about 0.8. Since there is theoretically no possibility that the segregation ratio becomes below the equilibrium distribution coefficient within the range of the center solid fraction during the thickness reduction rolling, 0.8 is employed as the lower limit of the segregation ratio. Therefore, the range of an elements-segregation ratio (C/Co) of 0.80 or more was taken as a target of specification.

A value of (C/Co) smaller than 1.20 is preferable since undesirable effects on mechanical properties of flat-rolled product or the like are aggravated in general when the value of (C/Co) exceeds 1.20.

Since the application of two-phase electromagnetic stirring is effective to decrease the maximum value of segregation ratio (C/Co) to 1.20 as shown in Table 1 of examples to be described below, with the range of an elements-segregation ratio (C/Co) of 1.20 or less was taken as a target of specification.

The following is the reason for setting the co-efficient in the right-hand side of the above-mentioned expression (1A) to 0.2. Namely, according to the examinations made by the present inventors, when the dilution of segregation-elements-concentrated molten steel by electromagnetic stirring is not performed upstream, in the casting direction, of the reduction rolling position of a slab, the value of the elements-segregation ratio (C/Co) tends to increase when the length (W), in a width-wise direction of slab, of each of segregation zones which emerge at both width-wise end portions of a liquid core exceeds about 20% of the length (W1), in a width-wise direction of slab, of a liquid core at the reduction rolling position of the slab. Therefore, the upper limit of W was set to W1 multiplied by 0.2.

The expression (1) specified by the present invention is obtained by substituting the above-mentioned expression (1B) into the expression (1A).

EXAMPLES

To confirm the effects of the present invention, casting test and numerical simulation related to the heat and flow in continuous casting as described below were performed, and results thereof were reviewed.

1. Target Process and Conditions of Numerical Simulation

[Target Process of Numerical Simulation]

Figure 11:
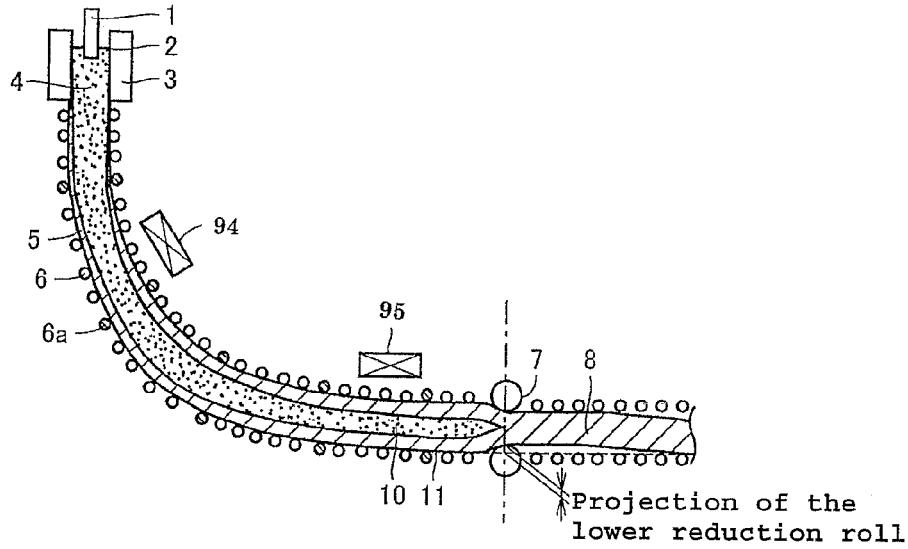
FIG. 11 are views schematically showing a longitudinal cross-section of a vertical bending type continuous casting machine for carrying out the continuous casting method of the present invention, wherein (a) is a schematic sectional view when carrying out the method without the bulging of a slab, and (b) is a schematic sectional view when carrying out the method while bulging a slab.
Figure 11:
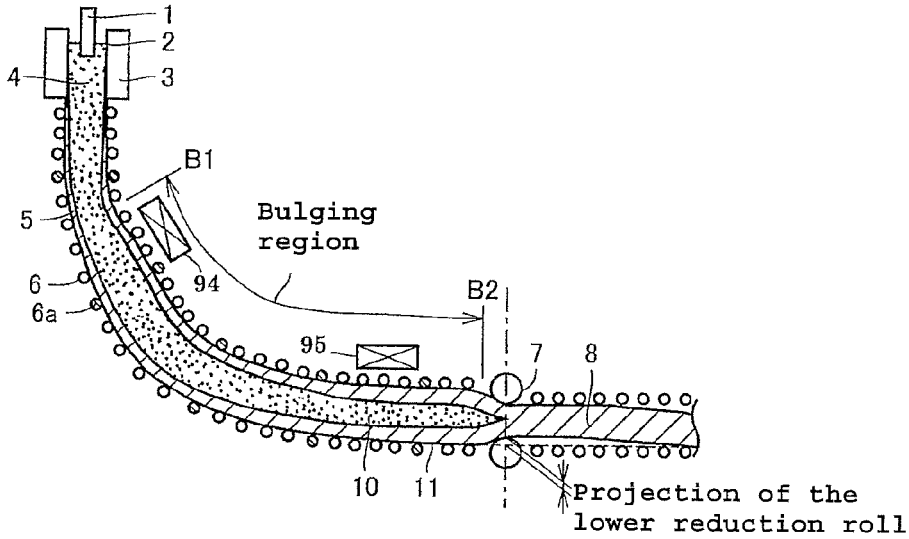

FIG. 11 are views schematically showing a vertical cross-section of a vertical bending type continuous casting machine for carrying out the continuous casting method of the present invention, wherein (a) is a schematic cross-sectional view for performing the method without the bulging of a slab, and (b) is a schematic cross-sectional view for performing the method with the bulging of a slab. FIG. 11 show a cross-sectional structure for effectively performing the thickness reduction of a slab 8, wherein the lower roll of a pair of reduction rolls 7 is projected upwardly over the lower pass line 11 of the slab.

Molten steel 4 poured into a mold 3 through an immersion nozzle 1 is cooled with spray water injected from the mold 3 and a set of secondary cooling spray nozzles (not shown) located below it, and a solidified shell 5 is formed to yield a slab 8. The slab 8 with a liquid core 10 therein is withdrawn downwardly while being supported by a set of guide rolls 6, and reduced in thickness by the pair of reduction rolls 7.

At that time, an electromagnetic force is imparted below the mold 3 and upstream, in the casting direction, of the pair of reduction rolls 7 by means of an electromagnetic stirrer 9 to thereby direct the unsolidified molten steel 10 from both minor sides of the slab 8 to the vicinity of the width-wise center, of slab so that flows of molten steel are collided against each other at the vicinity of the width-wise center, of slab.

In the cross-sectional configuration shown in FIGS. 11(*a*) and (*b*), a first electromagnetic stirring 94 and a second electromagnetic stirring 95 are installed. The distance from the molten steel surface (meniscus) 2 formed within the mold 3 to the pair of reduction rolls 7, the installment position of the electromagnetic stirrers and the like will be described later.

[Conditions of Numerical Simulation]

The conditions of numerical simulation are as follows. The pair of reduction rolls 7 was installed at a distance of 21.5 m downstream of the meniscus 2 of molten steel in the mold 3, each reduction roll 7 having a diameter of 470 mm and a maximum reduction rolling force of $5.88\times10^6$ N (600 tf). One electromagnetic stirrer (electromagnetic stirring 95) was installed at a distance of 6 m upstream, in the casting direction, of the reduction rolls 7.

For continuous casting parameters, a slab of 2260 mm wide and 270 mm thick was cast at a casting speed of 1.0 m/min, with the amount of superheat of molten steel in a tundish at that time (or the temperature difference obtained by subtracting the liquid phase line temperature from the molten steel temperature) being set to 25° C.

The numerical calculation is directed to a steel grade having a chemical composition of C: 0.02-0.20%, Si: 0.04-0.60%, Mn: 0.50-2.00%, P: 0.020% or less, and S: 0.006% or less was used.

A device having six exciting coils along a longitudinal direction of an iron core is used as the electromagnetic stirrer. For current application conditions, three-phase alternating current with a phase difference of 120° each was applied to each exciting coil in the same manner as the method shown in FIG. 8, a current value in an exciting coil was 75600 A·Turn and a frequency of current is 1.3 Hz. With respect to the stirring pattern, two types of stirring patterns, namely the uni-directional alternating flow forming-type stirring and the collision flow forming-type stirring were compared.

The evaluation of elements-concentration segregation was performed according to the following method. Namely, an initial condition was set such that Mn element was distributed at a uniform concentration of 1% in unsolidified molten steel within a transverse cross-section of the slab that lies within the range from the installment position of the electromagnetic stirrer to the position at a distance of 10 cm downstream, in the casting direction, thereof. The distribution of Mn concentration after 120 seconds was determined by heat-transfer and flow analyses, and the concentration segregation was evaluated based on this concentration distribution.

2. Evaluation of Result of Numerical Simulation

Figure 12:
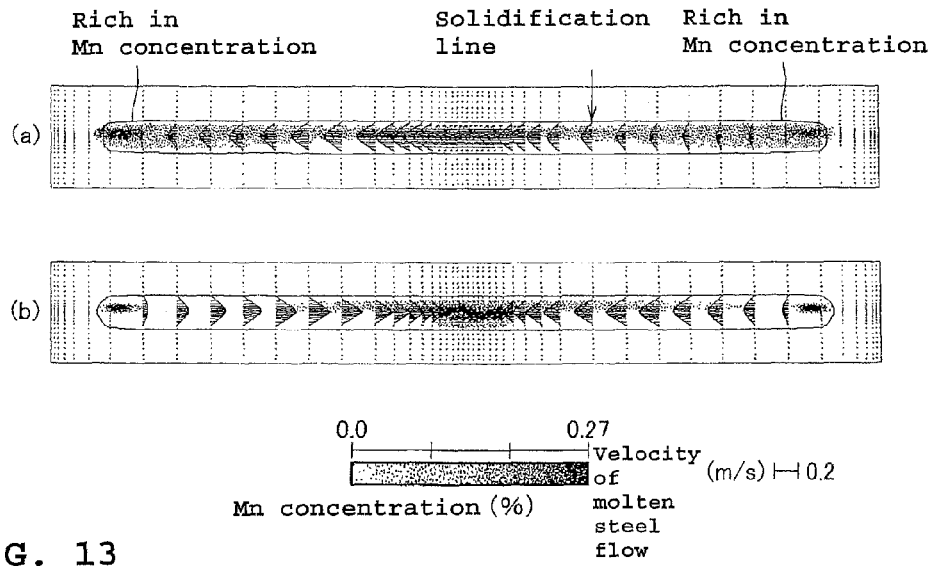
FIG. 12 are comparative views with respect to flow velocity distribution of molten steel and a Mn concentration distribution in a transverse cross-section of a slab, which are determined by numerical simulation, wherein (a) shows a flow velocity distribution of molten steel and a Mn concentration distribution in a casting method using the uni-directional alternating flow forming-type stirring, and (b) shows a flow velocity distribution of molten steel and a Mn concentration distribution in a casting method using the collision flow forming-type stirring.

FIG. 12 are comparative views with respect to the flow velocity distribution of molten steel and the distribution of Mn concentration in a transverse cross-section of slab, which were determined by numerical simulation, wherein (a) shows a flow velocity distribution of molten steel and the distribution of Mn concentration when a continuous casting was performed while imparting the uni-directional alternating flow forming-type stirring with a current value in an exciting coil of 75600 A·Turn and a frequency of current of 1.3 Hz, in which the moving direction of a magnetic filed was reversed at 30-second interval.

FIG. 12(*b*) shows a flow velocity distribution of molten steel and the distribution of Mn concentration when a continuous casting was performed while imparting the collision flow forming-type stirring under the same conditions of current value and current frequency. Each result in the same figures shows the distribution of Mn concentration within a transverse cross-section of slab at a distance of 3 m downstream of the electromagnetic stirrer.

Figure 13:
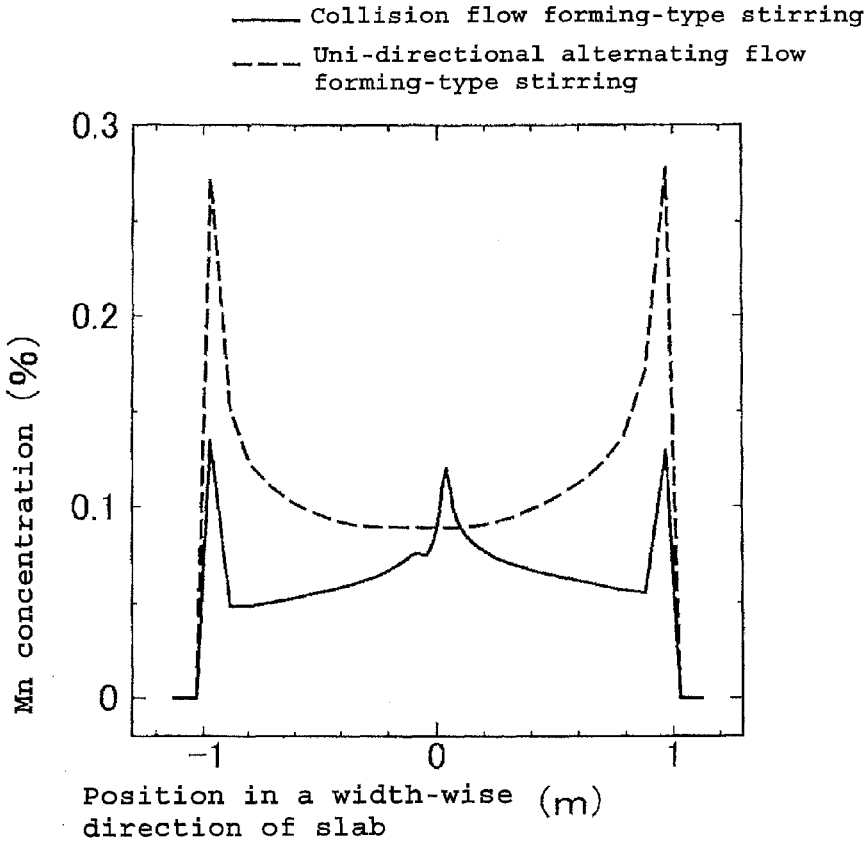
FIG. 13 is a graph comparatively showing the Mn concentration distribution in the thickness-wise central portion of a transverse cross-section of a slab, which is determined by numerical simulation, for each case of the uni-directional alternating flow forming-type stirring and the collision flow forming-type stirring.

FIG. 13 is a graph comparatively showing the distribution of Mn concentration in the thickness-wise central portion of a transverse cross-section of slab, which was determined by numerical simulation, with respect to the continuous casting method using the uni-directional alternating flow forming-type stirring and the collision flow forming-type stirring.

It was confirmed from the results of FIG. 12 and FIG. 13 that the concentration of Mn as a segregation element in the vicinity of either minor side of slab is decreased in the continuous casting method using the collision flow forming-type stirring, although the increase in Mn concentration is observed in the vicinity of either minor side of slab in the continuous casting method using the uni-directional alternating flow forming-type stirring.

FIG. 12(*b*) also demonstrates that stirred flows of molten steel collide against each other at the width-wise central portion (in the central portion of major side) of slab when the continuous casting was performed while imparting the collision flow forming-type stirring. Since the stirring effect is enhanced by flow disturbance resulting from such mutual collision of the flows of molten steel, the performance of diluting and stirring those elements such as Mn, which are likely to segregate, could be consequently improved.

Concretely, as is apparent from the results of FIGS. 12 and 13, the maximum value of the Mn concentration could be decreased to 0.13% by adopting the continuous casting method using the collision flow forming-type stirring, in contrast to the maximum value of the Mn concentration as being 0.27% in the continuous casting method using the uni-directional alternating flow forming-type stirring.

The above-mentioned result shows that, compared with the case where the unidirectional alternating flow forming-type stirring is simply applied, the segregation ratio of Mn (the value obtained by dividing the mass concentration of Mn in a segregation zone by the average mass concentration of Mn) could be decreased to about one-half by applying the continuous casting method and electromagnetic stirrer of the present invention. Thus, it could be verified by numerically analytical simulations that the continuous casting method of the present invention is sufficiently usable as a continuous casting technique capable of stably ensuring the center segregation quality over a long time.

3. Conditions of Casting Test

Based on the results of the numerically analytical simulation, casting test was performed by means of a vertical bending type continuous casting machine shown in FIG. 11(*a*). The casting test was performed under conditions: the steel chemical composition comprises C: 0.02-0.20%, Si: 0.04-0.60%, Mn: 0.50-2.00%, P: 0.020% or less and S: 0.006% or less; a thickness of a slab is 300 mm, which is slightly larger than that in the numerically analytic simulation, and a width of the slab is 2250 mm; a casting speed was 0.70 m/min; and the amount of secondary cooling water was 0.38 to 0.58 liters (L)/kg-steel.

The vertical bending type continuous casting machine shown in FIG. 11(*a*) is configured to perform the reduction rolling without the bulging of slab. Even in the case where the thickness of slab varies by bulging as shown in FIG. 11(*b*), heat-transfer calculation and solidification calculation are performed under the conditions that the casting speed is variously changed according to the thickness of the width-wise central portion of the slab 8. Thereby, a casting speed condition to provide a predetermined solid fraction distribution is obtained, and the casting test can be performed under the casting speed condition.

Therefore, the casting test using the vertical bending type continuous casting machine shown in FIG. 11(*a*) will be described herein.

In the casting test, the liquid core reduction rolling by a pair of reduction rolls was started at a time when a steady slab liquid core including unsolidified molten steel and having an intended center solid fraction reaches the reduction rolling position. After starting the reduction rolling, the amount of projection of the lower roll for reduction that projects upward from the lower pass line of the slab corresponds to the amount of thickness reduction of the slab by the lower reduction roll.

4. Method for Evaluating Elements in Slab by Casting Test

In the evaluation method of segregation of elements in a slab, a slab sample 150 mm in length was cut along a casting direction from the slab obtained by each casting test, and its macrostructure was observed and examined. Thereafter, samples for mapping analysis by EPMA (hereinafter referred also to as "MA analysis") were cut from each plate sample including a cross-section of the slab as shown in after-mentioned FIG. 17.

Each cut sample has a size of 100 mm long in a slab thickness-wise direction×40 mm wide in the casting direction×9 mm thick (in a slab width-wise direction). In all, samples were cut from five positions corresponding to one-fourths of, one-half of and three-fourths of the width of each slab along with both width-wise end portions as being segregation-elements enriched zones thereof, and each cut sample is then subjected to MA analysis.

The MA analysis was performed with respect to a visual field within the range of 50 mm in a slab thickness-wise direction×20 mm in a slab width-wise direction, including the thickness-wise center of slab for each MA sample. After the distribution of Mn was determined with a beam whose diameter being set to 50 μm, line analyses were performed in a width of 2 mm along a thickness-wise direction of slab to determine the concentration (C) of Mn in the thickness-wise center of slab, and the elements-segregation ratio (C/Co) was determined by dividing this value by the average concentration Co of Mn during casting.

A case with an elements-segregation ratio (C/Co) larger than 1 is called positive segregation, and this shows that the concentration of elements is higher than the average concentration of that in the base metal. A case with an elements-segregation ratio (C/Co) smaller than 1 is called negative segregation, and this shows that the concentration of elements is lower than the average concentration of that in the base metal.

5. Preferable Amount of Liquid Core Reduction Rolling According to the Amount of Superheat of Molten Steel As a result of further studies for the liquid core reduction rolling of a slab, the present inventors found that the amount of liquid core reduction rolling (d), which is mainly governed by the flow stress of aimed steel grade, is affected also by the amount of superheat (ΔT) of molten steel in a tundish in actual casting operation.

Figure 14:
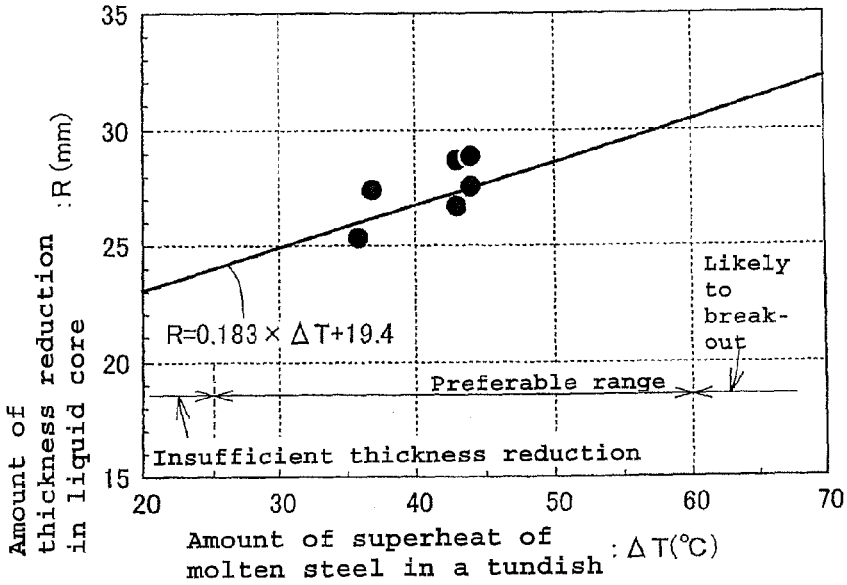
FIG. 14 is a graph showing a relationship between the amount of superheat of molten steel in a tundish and the thickness reduction rate of liquid core reduction.

FIG. 14 is a graph showing a relationship between the amount of superheat of molten steel in a tundish and the amount of liquid core reduction rolling. The result of the same figure is a test result under a condition such that solidified shell segments on the upper side and lower side are pressured against each other to be bonded in a maximum reduction rolling load. As is shown in the result of FIG. 14, the amount of liquid core reduction rolling increases according to the increase in the amount of superheat of molten steel in a tundish, and the relationship between the two is approximately represented by the following expression (3).

$$R=0.183\times\Delta T+19.4 \quad (3)$$

wherein R represents the amount of liquid core reduction rolling (mm), and ΔT represents the amount of superheat of molten steel in a tundish (° C.).

The relationship of the above-mentioned expression (3) shows that the amount of liquid core reduction rolling (R) decreases by about 1 mm upon the decrease of 5° C. in the amount of superheat (ΔT) of molten steel in a tundish. Accordingly, by preliminarily acquiring the relationship of the above-mentioned expression (3) for every steel grade, even if the steel grade is changed, solidified shell segments on upper side and lower side (top and bottom) can be surely pressured against each other to be bonded with preferable amount of liquid core reduction rolling.

An amount of superheat (ΔT) of molten steel below 25° C. is undesirable since the solidified shell segments on minor sides of slab cannot be sufficiently reduced in thickness. On the other hand, when the amount of superheat (ΔT) of molten steel becomes excessively high, exceeding 60° C., the thickness of the solidified shell in the mold is decreased, the break-out of slab is apt to occur near the lower end of the mold, and therefore casting speed has to be lowered. Thus, excessively high amount of superheat (ΔT) is undesirable.

The break-out referred to herein means a trouble such that the scattering of molten steel out of a solidified shell due to rupture of the solidified shell disables the continuous casting operation. The decrease in casting speed causes a change in the liquid core layer thickness at the position of liquid core reduction rolling of slab or in the distribution of center solid fraction, inhibiting appropriate reduction rolling of the slab.

As a concrete operation, the amount of thickness reduction of slab is adjusted according to the amount of superheat (ΔT)

of molten steel in a tundish, as shown in each test of aftermentioned Examples (Table 1), to surely pressure the solidified shell segments on upper side and lower side (top and bottom) against each other to be bonded. The amount of liquid core reduction rolling ranges from 24 mm (corresponding to a case with ΔT of 25° C.) to 30 mm (corresponding to a case with ΔT of 60° C.).

6. Installment Position of Electromagnetic Stirrer

The following explains the grounds of the desirable installment range of electromagnetic stirrer for performing the dilution and stirring of segregation-elements-concentrated molten steel by the present invention. The present inventors examined a distribution state of segregation-elements-concentrated molten steel within unsolidified molten steel which exists upstream, in the casting direction, of the reduction rolling position of slab under conditions of liquid core reduction rolling by means of the following method.

In the ending time period of casting, a gap between the reduction rolls, in a slab thickness-wise direction, is returned to the gap corresponding to the slab thickness before the liquid core reduction rolling (hereinafter referred also to as "freeing the reduction rolling"), segregation-elements-concentrated molten steel which had been successively discharged by liquid core reduction rolling so far was released at once, and solidification was completed with the segregation-elements-concentrated molten steel being trapped.

With respect to the freed slab of which solidification is completed, transverse samples of 150 mm long were collected from positions that lay upstream of the position where the reduction rolling was freed and that are at intervals of 2 to 3 m along the casting direction. A transverse cross-section of each slab sample was subjected to macro-etching treatment. Positions of segregation-elements enriched zones were recorded. The segregation-elements enriched zone can be macroscopically elucidated as a pale black indication.

A distribution state of the enriched zones of segregation elements on the upstream site, in the casting direction, of the position of liquid core reduction rolling was acquired by successively connecting each position of enriched zones of segregation elements. The enriched zones of segregation elements is an area with an elements-segregation ratio (C/Co) of 1.0 or more, which can be judged by macroscopic observation as described above. An accurate value of the segregation ratio (C/Co) was measured and confirmed by MA analysis.

Figure 15:
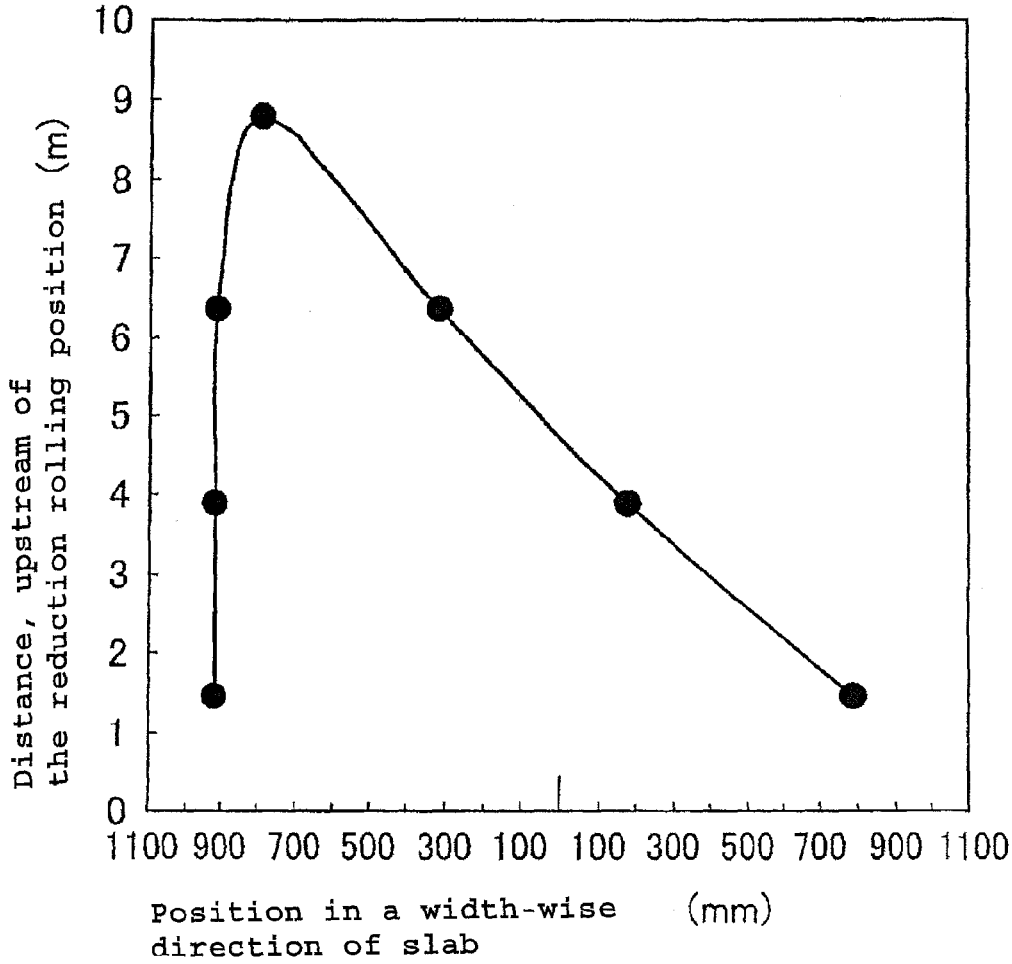
FIG. 15 is a graph showing one example that segregation-elements-concentrated molten steel discharged by the liquid core reduction rolling flows back from the reduction rolling position toward upstream.
Figure 16:
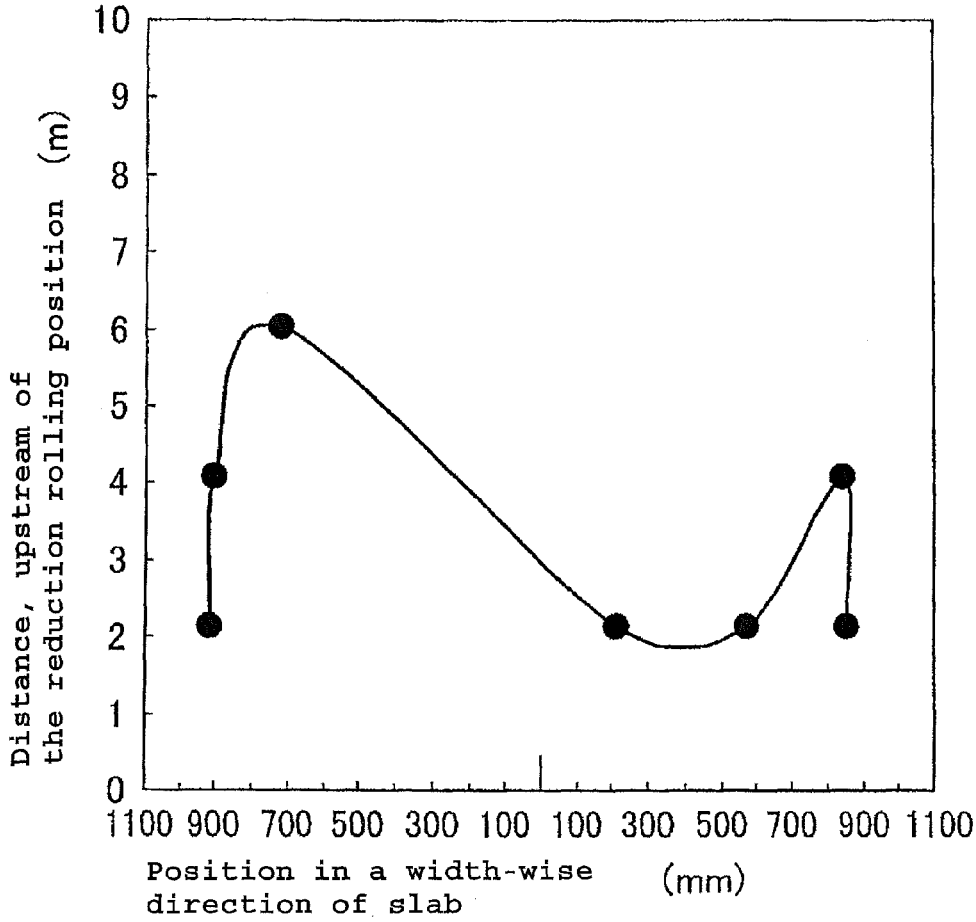
FIG. 16 is a graph showing another example that segregation-elements-concentrated molten steel discharged by the liquid core reduction flows back from the reduction rolling position toward upstream.

FIG. 15 is a graph showing one example of examination result for the upstream range how far segregation-elements-concentrated molten steel discharged by liquid core reduction rolling flows back from the reduction rolling position. FIG. 16 is a graph showing another example of examination result therefor. According to the result of FIG. 15, the segregation-elements-concentrated molten steel flows back up to 9 m upstream, in the casting direction, of the reduction rolling position. The result of FIG. 16 also shows that the segregation element-concentrated molten steel flows back up to 4 to 6 m upstream in the casting direction. These results reveal that the segregation-elements-concentrated molten steel flows back to a position about 4 to 9 m upstream, in the casting direction, of the position of liquid core reduction rolling.

Thus, considering the above-mentioned flow-back distance of segregation-elements-concentrated molten steel, the present inventors install the above-mentioned electromagnetic stirrer, which had been developed with the aim of diluting and stirring segregation-elements-concentrated molten steel discharged by liquid core reduction rolling, in a device segment located at a distance of 5.0 to 6.8 m upstream, in the casting direction, of the position of liquid core reduction rolling.

7. Conditions of Casting Test and Examples

Using the continuous casting machine shown in FIG. 11(*a*), the casting test was performed for each of Test Nos. 1 to 4. The continuous casting machine shown in the same figure includes an electromagnetic stirrer 94 used for improvement in qualitys of equiaxed structure or the like (hereinafter referred to as "first electromagnetic stirring") and an electromagnetic stirrer 95 used for dilution and stirring of elements-concentrated molten steel (hereinafter referred to as "second electromagnetic stirring").

The first electromagnetic stirring forms a uni-directional alternating flow, in a slab width-wise direction, in molten steel. The first electromagnetic stirring has a system for generating a moving magnetic field in a width-wise direction of slab by passing, for example, two-phase alternating current composed of two types of alternating current differing in phase by 90° through the electromagnetic stirring coil while reversing the moving direction of magnetic field at a predetermined time interval, and imparts the uni-directional alternating flow forming-type stirring.

The first electromagnetic stirring was installed at a distance of 12 m upstream of the reduction rolling position of the slab, and used it in as-is condition to contribute to the dilution on the upstream site. The current value in an electromagnetic stirring coil was set to 75600 A·Turn (device current: 900A) with a frequency of 1.3 Hz.

The second electromagnetic stirring, which is the electromagnetic stirrer of the present invention, has a moving magnetic field system having the same function as a primary iron core of a linear induction electric motor, and can selectively impart the uni-directional alternating flow-forming stirring and the collision flow-forming stirring.

The second electromagnetic stirring was installed in a device segment located at a distance of 5.0 to 6.8 m from the reduction rolling position of the slab, and the current value was set to 75600 A·Turn (device current: 900 A) with a frequency of 1.5 Hz in both the uni-directional alternating flow forming-type stirring and the collision flow forming-type stirring.

In Test Nos. 1 to 4, the amount of liquid core reduction rolling was appropriately ensured according to the amount of superheat ΔT of molten steel in a tundish. Concretely, the amount of superheat ΔT of molten steel ranges from 25 to 60° C., and the amount R of liquid core reduction rolling was set by the following expression (3) according to this.

$$R=0.183\times\Delta T+19.4 \quad (3)$$

Other test conditions and test results are shown in Table 1. In Table 1, Test No. 1 is a Comparative Example without installing of the second electromagnetic stirring. Test Nos. 2 to 4 are Inventive Examples, in which the uni-directional alternating current forming-type stirring or the collision flow forming-type stirring was selectively imparted by the second electromagnetic stirring.

TABLE 1

| Test No. | Class | Test Conditions: Slab Dimension: Thickness (mm) × Width (mm) | Casting Speed (m/min) | Amount of Superheat of Molten Steel ΔT(° C.) | Set Value of Amount R of Liquid Core Reduction Rolling (mm) | First Electro-magnetic Stirring (900 A) | Second Electro-magnetic Stirring (900 A) | Test Result: Length W of Segregation Zone at Thickness-wise Center of Slab (mm) | Segregation Ratio of Mn at Thickness-wise Center of Slab C/Co(—) | Number of Times of Sequence Castings |
|---|---|---|---|---|---|---|---|---|---|---|
| 1 | Comparative Example | 300 × 2250 | 0.70 | 25-60 | Set by Expression(3) | Two-Phase Alternating Flow Stirring | Non | 400 or more | 1.40 | X |
| 2 | Inventive Example | | | | | | Two-Phase Alternating Flow Stirring | from 100 to 200 | 1.20 | 2 |
| 3 | Inventive Example | | | | | | Three-Phase Alternating Flow Stirring | 100 or less | 1.15 | 3 or more |
| 4 | Inventive Example | | | | | | Three-Phase Collision Flow Stirring | 100 or less | 1.10 | 3 or more |

Note:
* The alternating flow stirring means "uni-directional alternating flow forming-type stirring", and the collision flow stirring means "collision flow forming-type stirring".
* W shows the length, in a slab width-wise direction, of each of segregation zones existing at both width-wise end portions of slab.

In Test No. 1, segregation-elements-concentrated molten steel could not be sufficiently discharged although liquid core reduction rolling was performed based on the relationship of the expression (3) according to the amount of superheat ΔT of molten steel in a tundish that is measured in casting.

Figure 17:
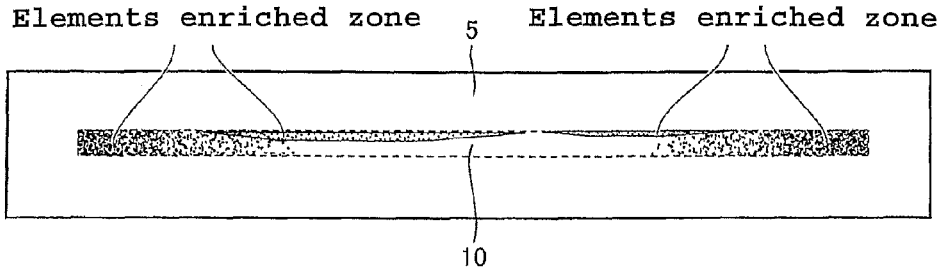
FIG. 17 is a view showing a macroscopic distribution of elements in a transverse cross-section of a slab which shows a deteriorating tendency of segregation quality, wherein segregation-elements-concentrated molten steel is trapped in some places without being sufficiently discharged.

FIG. 17 is a view showing a macrostructure distribution state of elements in a transverse cross-section of a slab which showed a deterioration tendency of segregation qualities, in which the segregation-elements-concentrated molten steel was trapped without being sufficiently discharged. As shown in the same figure, macroscopic segregation qualities in the transverse cross-section of the slab were deteriorated in Test No. 1 due to the existence of a positive segregation zone with a segregation ratio of elements (C/Co) exceeding 1.

Figure 18:
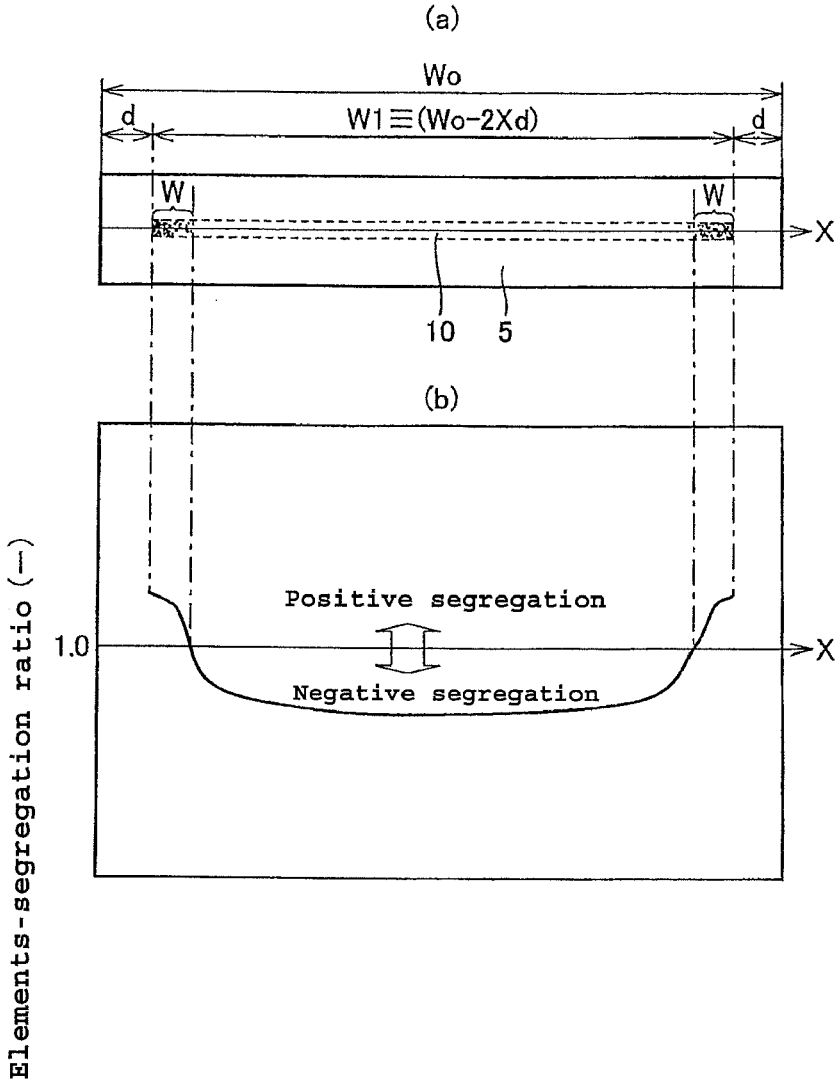
FIG. 18 are views schematically showing a segregation state along a width-wise direction in a transverse cross-section of a slab subjected to the liquid core reduction rolling, wherein (a) shows segregation-remaining positions as being at width-wise end portions of slab, and (b) shows the distribution of elements-segregation ratios along a width-wise direction of slab.

FIG. 18 are views showing a segregation state, in width, in a transverse cross-section of a slab which was subjected to liquid core reduction rolling based on the relationship of FIG. 14, wherein (a) shows segregation-remaining positions at width-wise end portions, and (b) shows a distribution, in a slab width-wise direction, of the elements-segregation ratios. The segregation state, in width, in the transverse cross-section of a slab subjected to liquid core reduction rolling in Test No. 1 results in as shown in FIG. 18.

In Test No. 1, further, since the dilution by the second electromagnetic stirring was not performed, the length (W), in the slab width-wise direction, of each of segregation zones with an elements-segregation ratio of 0.8 to 1.20, which exist at both width-wise end portions, of slab remained over 400 mm or more in a width-wise direction, and exceeded 20% of the length (W1), in the slab width-wise direction, of a slab liquid core at the reduction rolling position, so as not to satisfy the relationship represented by the above-mentioned expression (1). Consequently, the maximum value of the segregation ratio of Mn reached 1.40, resulting in a slab deteriorated in center segregation qualities and also poor in internal quality as having center porosity dispersed in a transverse cross-section of the slab.

In Test No. 2, the diluting effect was improved by imparting the uni-directional alternating flow forming-type stirring by a two-phase electromagnetic stirrer in the second electromagnetic stirring, the maximum value of the segregation ratio of Mn was decreased to 1.20, and the width of each enriched zone in the slab thickness-wise central part at width-wise end portions of slab was also decreased to 100 to 200 mm. In this case, the expression (1) specified by the present invention could be satisfied, although in the vicinity of the upper limit range thereof.

Further, in Test No. 3, the stirring force could be enhanced in addition to improvement in the diluting effect by imparting the uni-directional alternating flow forming-type stirring by means of a three-phase electromagnetic stirrer in the second electromagnetic stirring, the maximum value of the segregation ratio of Mn was decreased to 1.15, and the width of each enriched zone in the thickness-wise central part at width-wise end portions of slab was also decreased to 100 mm or less.

In Test No. 4, the maximum value of the segregation ratio of Mn was improved to 1.10 or less by imparting the collision flow forming-type stirring by means of a three-phase electromagnetic stirrer in the second electromagnetic stirring, although the width of each enriched zone in the thickness-wise central part at width-wise end portions of slab was 100 mm or less similarly to Test No. 3.

As described above, in Test Nos. 2 to 4 that are Inventive Examples, the length (W), in the slab width-wise direction, of each of positive segregation zones existing at both width-wise end portions of the slab could be suppressed to 20% or less of the length (W1=Wo−2d), in the slab width-wise direction, of a slab liquid core at the reduction rolling position, and the relationship of the expression (1) specified by the present invention could be satisfied.

Accordingly, in Test Nos. 2 to 4 that are Inventive Examples, extremely excellent results could be obtained, including improvement in center segregation qualities, extremely excellent effect of diluting the segregation-elements-concentrated molten steel, and practicability of long-time continuous casting with the number of times of sequential continuous casting (the number of times that continuous casting can be sequentially performed) being two or more, further three or more.

Further, the electromagnetic stirrer of the present invention can attain the collision flow forming-type stirring and the uni-directional alternating flow forming-type stirring by means of the same electromagnetic stirrer. Such a configuration is effective for the decrease in facility and equipment costs or improvement in maintainability, and can cope with various casting conditions due to the selectiveness of stirring method.

Of course, needless to say that the same effect can be attained by separately installing an electromagnetic stirrer for imparting the uni-directional alternating flow forming-type stirring and an electromagnetic stirrer for imparting the collision flow forming-type stirring, it is undeniable that the separately installing is inefficient from the viewpoint of facility and equipment costs and maintenance, and allowable casting conditions are limited. The present invention can solve these problems, too.

INDUSTRIAL USABILITY

The continuous casting method and electromagnetic stirrer of the present invention provides a continuous casting in which an electromagnetic stirrer is installed upstream, in the casting direction, of a reduction rolling position of a slab, and in which a slab with a liquid core is reduced in thickness, wherein molten steel with concentrated-segregation-elements can be stirred and diffused in a width-wise direction of slab by imparting the collision flow forming-type stirring and the uni-directional alternating flow forming-type stirring. And a slab stabilized in center segregation qualities can be produced over long-time casting operation.

Further, the continuous casting method and electromagnetic stirrer of the present invention are effective for the decrease in facility and equipment costs or improvement in maintainability and can extensively cope with various casting conditions, since the collision flow forming-type stirring and the uni-directional alternating flow forming-type stirring are selectively imparted by means of the same electromagnetic stirrer.

Thus, the continuous casting method and electromagnetic stirrer of the present invention are techniques that can be applied extensively as a continuous casting method capable of stably ensuring excellent center segregation qualities over a long time in casting of high-strength steel with high crack susceptibility and steel grade for extremely thick plate product.

What is claimed is:

1. An electromagnetic stirrer of molten steel disposed at a distance of less than 9 m upstream, in the casting direction, of a reduction rolling position of a slab with a liquid core to stir molten steel of the liquid core in a width-wise direction of the slab, comprising:

an iron core disposed with its length-wise axis along a width-wise direction of slab; and a plurality of exciting coils that are wound around the outer circumference of and about a length-wise axis of the iron core, in which two-phase or three-phase alternating current is passed through the exciting coils, and when imparting a stirring flow which causes molten steel to flow from both minor sides of slab toward the width-wise center, of slab so as to collide with each other in the vicinity of the width-wise center of slab, the phases of current in the exciting coils are distributed symmetrically, with respect to the iron core length-wise center position corresponding to the width-wise center of slab, along a length-wise direction of the iron core, when imparting a stirring flow which causes molten steel to flow from one minor side of the slab toward the other minor side thereof while reversing the flowing direction at a predetermined time interval, the phases of current in exciting coils are distributed in such a manner that the phase of current of exciting coils at one width-wise end portion of iron core increases or decreases by 90 or 60° sequentially from that at the other width-wise end portion, and the stirring flow is selectively imparted.

* * * * *